US007234212B2

(12) United States Patent
Colson et al.

(10) Patent No.: US 7,234,212 B2
(45) Date of Patent: Jun. 26, 2007

(54) METHOD OF WINDING A BEAM

(75) Inventors: Wendell B. Colson, Weston, MA (US); David Hartman, Framingham, MA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 11/336,476

(22) Filed: Jan. 19, 2006

(65) Prior Publication Data

US 2006/0143881 A1 Jul. 6, 2006

Related U.S. Application Data

(62) Division of application No. 10/443,690, filed on May 21, 2003, now Pat. No. 7,017,244.

(60) Provisional application No. 60/385,694, filed on Jun. 3, 2002.

(51) Int. Cl.
*D02H 5/00* (2006.01)

(52) U.S. Cl. ..... 28/190; 28/194

(58) Field of Classification Search ..... 28/194, 28/195, 196, 190, 199, 198, 191, 192, 193, 28/197, 200, 212, 172.1, 172.2, 178, 179, 28/180, 185, 201; 242/157 R, 147 A, 131, 242/131.1, 125, 118, 129.1, 130
See application file for complete search history.

(56) References Cited

U.S. PATENT DOCUMENTS

| | | | | |
|---|---|---|---|---|
| 305,502 | A | 9/1884 | Berckmans | |
| 344,093 | A | 6/1886 | Entwistle | |
| 687,359 | A | 11/1901 | Whitney | |
| 1,462,604 | A * | 7/1923 | Lavalle | 28/194 |
| 1,890,197 | A | 12/1932 | Sussmuth | |
| 2,728,132 | A | 12/1955 | Shattuck et al. | |
| 2,797,728 | A | 7/1957 | Slayter et al. | |
| 2,956,328 | A | 10/1960 | Faw | |
| 3,460,771 | A * | 8/1969 | Kimpton | 242/486.4 |
| 3,508,722 | A | 4/1970 | Kohl | |
| 3,533,543 | A * | 10/1970 | Wenger | 28/194 |
| 3,575,359 | A | 4/1971 | Furst | |

(Continued)

FOREIGN PATENT DOCUMENTS

| | | |
|---|---|---|
| CA | 889808 | 1/1972 |

(Continued)

*Primary Examiner*—Amy B. Vanatta
(74) *Attorney, Agent, or Firm*—Dorsey & Whitney LLP

(57) ABSTRACT

An apparatus and method for winding a sheet of aligned parallel yarns onto a beam is described. The beam winder utilizes a circularly arced yarn spool rack that feeds each yarn to an alignment comb through associated guide tubes. The distance between each spool of yarn and the alignment comb is substantially the same for all spools of yarn, thereby equalizing the force necessary to pull them to the comb. Next, the aligned sheet of material is preshrunk using heated rollers and wound onto a beam. Multiple speed controlled stepper motors are utilized to maintain a constant low level of tension in the sheet during the shrinking process. After shrinkage, the tension level of the yarn sheet is increased as it is wrapped onto the beam. A turntable that supports two or more beams is provided to facilitate the rapid switching of beams once one beam has become full.

9 Claims, 19 Drawing Sheets

U.S. PATENT DOCUMENTS

| | | | | | |
|---|---|---|---|---|---|
| 3,591,434 | A | | 7/1971 | Hartstein | |
| 3,595,276 | A | * | 7/1971 | Wrzesien | 28/198 |
| 3,663,331 | A | | 5/1972 | Solbeck | |
| 3,686,048 | A | | 8/1972 | Schirtzinger | |
| 3,737,950 | A | | 6/1973 | Bolliand et al. | |
| 3,884,429 | A | | 5/1975 | Dow | |
| 4,132,828 | A | | 1/1979 | Nakamura et al. | |
| 4,265,691 | A | | 5/1981 | Usui | |
| 4,411,722 | A | | 10/1983 | Yazawa et al. | |
| 4,417,374 | A | * | 11/1983 | Kuroda et al. | 28/181 |
| 4,464,891 | A | | 8/1984 | Manley, Jr. | |
| 4,498,941 | A | | 2/1985 | Goldworthy | |
| 4,511,424 | A | | 4/1985 | Usui | |
| 4,525,905 | A | | 7/1985 | Bogucki-Land | |
| 4,687,528 | A | | 8/1987 | Held | |
| 4,850,086 | A | * | 7/1989 | Schewe | 28/196 |
| 5,046,224 | A | | 9/1991 | Bogucki-Land et al. | |
| 5,061,545 | A | | 10/1991 | Li et al. | |
| 5,097,783 | A | | 3/1992 | Linville | |
| 5,558,016 | A | | 9/1996 | De Brock | |
| 5,613,643 | A | | 3/1997 | Weiner | |
| 5,675,878 | A | * | 10/1997 | Brown et al. | 28/172.2 |
| 6,233,798 | B1 | | 5/2001 | Bogucki-Land | |
| 6,367,675 | B1 | | 4/2002 | Woerner | |
| 6,634,585 | B1 | | 10/2003 | Ingram, III | |
| 6,981,394 | B2 | * | 1/2006 | Keller | 28/163 |
| 2003/0233744 | A1 | | 12/2003 | Colson et al. | |

FOREIGN PATENT DOCUMENTS

| | | | |
|---|---|---|---|
| DE | 2007915 | * | 11/1970 |
| DE | 30 46 432 | | 8/1982 |
| DE | 30 46 431 | | 9/1982 |
| EP | 0 255 596 | | 2/1988 |
| EP | 0 292 266 | | 11/1988 |
| EP | 0 470 584 | | 2/1992 |
| EP | 0 885 803 | | 12/1998 |
| GB | 407 342 | | 3/1934 |
| GB | 1 266 581 | | 3/1972 |
| GB | 1 440 081 | | 6/1976 |
| GB | 1 463 969 | | 2/1977 |
| GB | 2 041 028 | | 9/1980 |
| JP | 63-267525 | | 11/1988 |
| JP | 1-210318 | | 8/1989 |
| WO | WO 80/02850 | | 12/1980 |
| WO | WO 00/41523 | | 7/2000 |
| WO | WO 01/21383 | | 3/2001 |
| WO | WO 01/21399 | | 3/2001 |
| WO | WO 01/21877 | | 3/2001 |

* cited by examiner

METHOD OF WINDING A BEAM

CROSS REFERENCE TO RELATED APPLICATIONS

This application is a divisional of U.S. application Ser. No. 10/443,690 (the '690 application), filed 21 May 2003, now U.S. Pat. No. 7,017,244 which claims priority under 37 U.S.C. § 119(e) to U.S. provisional application No. 60/385,694 (the '694 application), filed 3 Jun. 2002. The '690 and '694 applications are hereby incorporated by reference as though fully set forth herein, in their entirety.

BACKGROUND OF THE INVENTION

1. Field of the Invention

This invention relates generally to a textile fabrication apparatus, and more specifically to a beam winder apparatus for aligning and winding a plurality of textile yarns, threads or filaments on a spool or beam.

2. Description of Background Art

An apparatus for winding a plurality of unidirectionally aligned threads, yarns or filaments onto a beam is well known in the art. This type of apparatus is typically referred to as a "beam winder" or a "warping machine." (the aligned yarns often form the warp direction of a subsequently fabricated fabric). In general, a beam winder (1) unwinds a large number of yarns from spools or bobbins on which the yarns are individually wound, (2) aligns the yarns from each spool in a common direction (typically horizontal) in a planar relationship, and (3) winds the aligned planar plurality of yarns on to a beam.

The resulting beams of aligned yarns are then utilized in subsequent textile processing operations. For example, the aligned yarns from several beams may be commingled to generate wider beams of aligned yarns with a denser concentration of yarns (typically measured in yarns per inch). The beams may also be utilized in a loom, wherein the yarns are unwound from the beam and weft or fill fibers are interwoven among the aligned yarns to create a woven fabric. Additionally, transversely aligned (weft) yarns or a non-woven matt may be adhesively bonded to the aligned planar yarns as they are unwound from the beam to create a non-woven fabric material.

A typical beam winder includes a longitudinally-extending framework. A beam coupled with a motor is positioned at one end of the winder to receive the plurality of aligned planar yarns. A comb is positioned upstream from the beam. The comb includes a large number of holes (one for each individual yarn) through which the end of each individual yarn is threaded. Each hole is positioned to align the yarn passing through in the horizontal direction relative to the other yarns. A series of racks configured with a certain number of yarn spools are positioned upstream of the comb. Given (i) the large number of spools (typically hundreds), (ii) the longitudinal orientation of the framework, and (iii) the required spacing between adjacent spools due to the nominal diameter of the spools, it is necessary to utilize a number of racks positioned at differing distances from the comb. Often as a yarn passes from its spool to the comb it passes through a number of eyelets that help to support the yarn and the comb and prevent the yarn from tangling with the other yarns. During machine setup, yarn from each spool must be individually and manually threaded through each eyelet and through its specific opening in the comb. Given the hundreds of spools typically utilized, the setup process is both costly and time consuming.

Given the varying distances that different yarns must travel from their spools to the comb and then to the beam, different amounts of force are required to pull each yarn onto the beam. The required force is primarily related to overcoming the weight of any unsupported unwound yarn hanging between the spool and the comb; the friction resulting from the yarn being pulled through the eyelets, and air friction related to the length of the yarn. Accordingly, a greater force is required to pull a yarn from a spool as the distance between the spool and the comb increases. The force necessary to move a yarn ultimately relates to the residual tension of a yarn as it is wrapped onto the beam. Simply, the tension in a yarn is equal to the force required to pull it divided by the cross sectional area of the yarn.

In some beam winders designed for use with monofilaments threads or threads comprised of a plurality of continuous filaments (not spun yarns), a heater is disposed between the comb and the beam. The heater momentarily exposes the threads to a high level of heat while the threads are stretched to both increase the strength of the threads and reduce the diameter of the threads to a desired denier.

Current art beam winders do not have the ability to preshrink the yarns during the beam winding process, so when sheets of aligned preshrunk yarns are desired, the individual spools of yarn are preshrunk prior to use on the beam winder or the yarn sheet winding of a beam is preshrunk in a separate operation. Separate preshrinking operations add to the cost of the products produced from the yarn sheet and depending on how the preshrink process is performed, the shrinkage may not be uniform from yarn to yarn or from one section of a yarn to another.

Aligned yarn sheets of preshrunk yarns are often essential, however, in the production of non-woven fabrics, especially when the yarns utilized in the non-woven fabric are of the spun-type. In pressurized lamination processes often used to laminate weft fibers or a non-woven mat to the warp fibers of a yarn sheet, relatively high temperatures may be utilized to liquefy a hot melt adhesive. If the constituent fibers of yarn sheet have not been preshrunk, they can shrink during the lamination process and can distort the weft fibers or non-woven mat to which they are adhesively attached resulting in non-woven fabrics that are not aesthetically acceptable. Further, even when the yarn sheet has been preshrunk, non-uniform, unacceptable non-woven fabrics can result, if the yarns comprising the yarn sheet were not shrunk uniformly.

BRIEF SUMMARY OF THE INVENTION

An apparatus for winding a beam of aligned planar yarns is described. In one embodiment of the beam winder, one or more racks are specified with a plurality of spool holders for holding a plurality of yarn spools. The beam winder further includes a comb with a plurality of openings therein for aligning the yarn of each spool such that each yarn is offset in one direction from each other yarn of the plurality of yarn spools. The distance between each spool holder and an associated opening in the comb is substantially the same for all the spool holders of the plurality of spool holders and their associated openings.

In another embodiment of the beam winder, one or more racks are specified with a plurality of spool holders for holding a plurality of yarn spools. The beam winder further includes a comb with a plurality of openings therein for aligning the yarn of each spool such that each yarn is offset in one direction from each other yarn of the plurality of yarn spools. Additionally, the beam winder includes a plurality of tubes. Each tube extends from a first end proximate a spool holder to a second end proximate an associated opening in the comb.

In yet another embodiment, the beam winder is comprised of an alignment section for aligning a plurality of continuous yarns in a parallel planar relationship. The beam winder also includes a shrink section which is adapted to receive the aligned planar yarns, apply a first tensioning force to the yarns, and shrink the yarns. A winding section is also provided to receive the aligned yarns from the shrink section, apply a second tensioning force that is greater than the first tensioning force to the yarns, and finally, wind the yarns onto a beam. The beam winder is also configured to prevent the transfer of the second tensioning force from the portion of the aligned planar yarns in the winding section to the portion of the aligned planar yarns in the shrink section.

In a fourth embodiment, the beam winder includes: (i) a comb similar to the combs described above; (ii) a first set of rollers that rotate at a first speed around which a aligned yarn sheet is passed; (iii) a second set of rollers that rotate at a second speed that is slower than the first speed; (iv) one or more stepper motors to rotate the first and second sets; (v) a heater maintained at an elevated temperature for heating the aligned yarn sheet; and (vi) a beam drive mechanism to couple with a beam and rotate it.

A method for using a beam winder of one or more of the described embodiments is also described. In one embodiment of the method, a plurality of yarns are aligned into a yarn sheet in a parallel planar relationship with each other. Next, the yarn sheet is shrunk, and finally, the shrunk yarn sheet is wound onto a beam.

Another method is described for setting up the beam winding prior to winding the aligned planar yarn onto a beam. First, spools of yarn are loaded onto the spool holders. Next, the end of each yarn from each spool is fed through a guide tube by inducing a flow of air down the interior of the tube. Finally, the end of each yarn is fed through its respective opening in the comb.

Other aspects, features and details of the present invention can be more completely understood by reference to the following detailed description of the preferred and selected alternative embodiments, taken in conjunction with the drawings and the appended claims.

DETAILED DESCRIPTION OF THE INVENTION

Definitions

Beam: As used herein, a beam refers to any spool that is typically, but not necessarily, cylindrically-shaped that may have top and bottom flanges on which the plurality of aligned yarns of the beam winder are wound.

Yarn: As used herein, a yarn is a continuous strand of one or more fibers or filaments made from any suitable organic or inorganic, natural or synthetic material. Unless otherwise specifically indicated the term "yarn" is not limited to strands that are spun from a plurality of filaments.

Yarn Sheet: As used herein, a yarn sheet refers to the plurality of aligned planar yarns produced during the beam winding process.

Spool: As used herein, spool refers to any article adapted to hold a quantity of continuous yarn. Typically, yarn is wound onto a spool.

Comb: As used herein, a comb refers to a portion of the beam winder that acts to align the plurality of yarns that pass through it in a parallel non-overlapping relationship along a single direction. The comb can comprise a single element or a plurality of separate elements. For instance, in the preferred embodiment described below the comb comprises a plurality of bars that each have a number of holes passing through them in a specific relationship. In another embodiment, the combs can be the composite of the ends of a plurality of guide tubes arranged in a prescribed manner.

The Beam Winder

Figure 1:
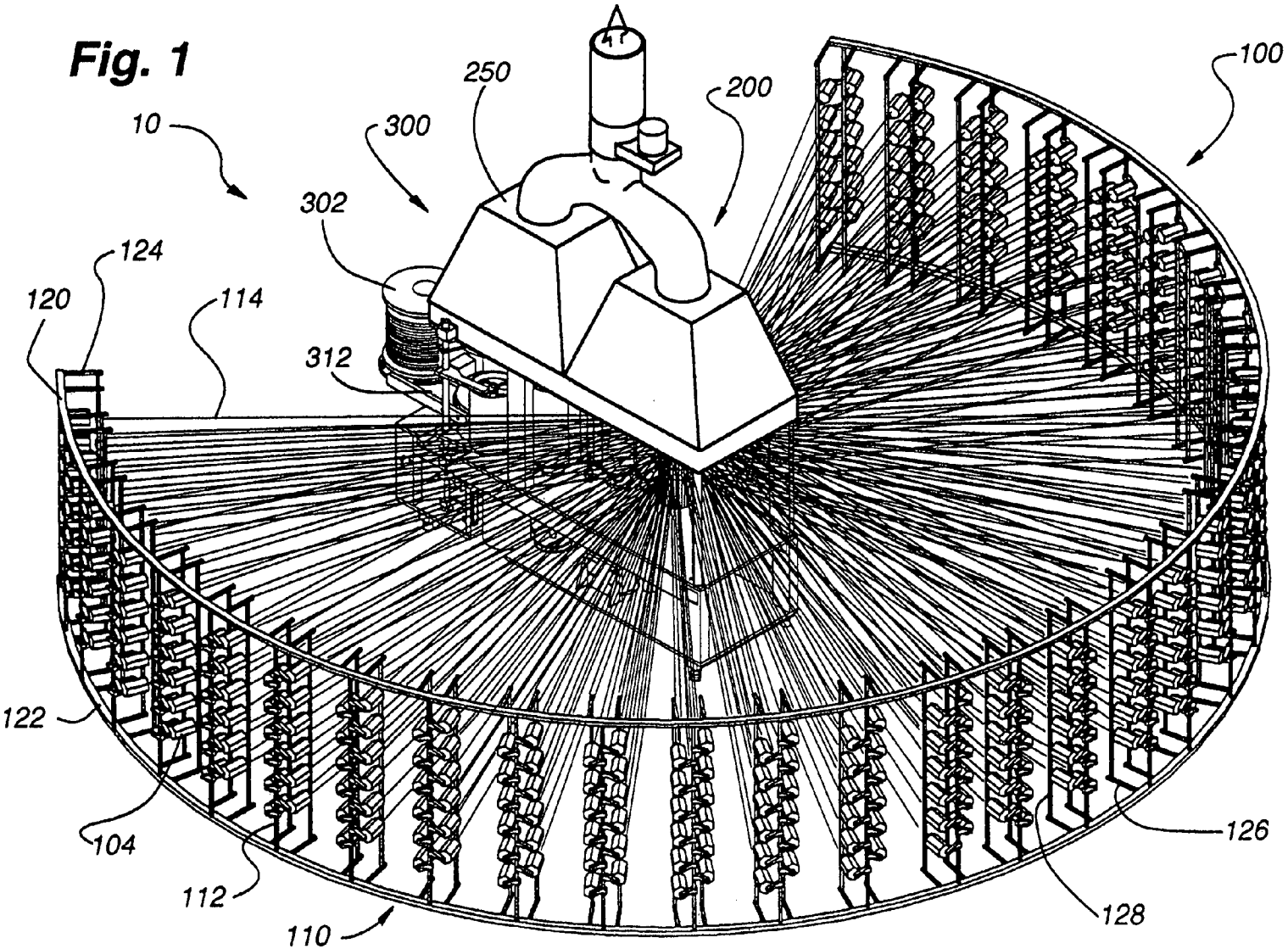
FIG. 1 is an isometric view of the beam winding apparatus.

A beam winding apparatus and a method of using the apparatus are described. The beam winder as illustrated in FIG. 1–4 is comprised of three sections: (1) a yarn supply and alignment section 100 (supply section) where the yarns 102 are unwound from their respective spools 104 and fed through positioned openings in a comb 106 (see FIG. 2); (2) a preshrink section 200 wherein the aligned planar yarns 102 are evenly shrunk; and (3) a beam section 300 wherein the shrunk and aligned yarns are wound onto a beam 302. As illustrated in FIG. 1, the beam winder can also include a vent hood 250.

As illustrated in FIGS. 1–11 and 17–19, the yarn supply section 100 is configured to minimize the force required to unwind each yarn 102 from its spool 104 and pull the yarn through its respective opening 108 in the comb 106. Further, the supply section is configured so that the force to pull each yarn is substantially equal to the force required to pull any other yarn. A single spool rack 110 in the shape of a circular arc is utilized that has a plurality of vertical columns 112 with spools 102 attached thereto spaced along its circumference. In alternative embodiments, a plurality of distinct racks can be utilized that are arranged in the configuration of a circular arc. One end of a guide tube 114 is attached to the rack 110 in front of each spool. Each guide tube extends radially inwardly towards a circularly-arced comb 106, whereat each guide tube 114 terminates at the appropriate yarn opening 108 in the comb. Preferably, the center axis of the comb's arc and center axis of the rack's arc are substantially co-extensive. The yarns 102 are thread through their respective tubes 114 and through their respective openings 108 in the comb 106. The guide tubes support the yarns along substantially their entire length between the spool 104 and the comb 106, significantly reducing the force necessary to pull each yarn to the comb as compared to prior art configurations. Further, the distance traveled by each yarn through its tube is substantially the same as the distance traveled by each other yarn utilized in the beam winder 10, thereby equalizing the force required to pull each yarn to the comb. Additionally, a pneumatic feed mechanism 118 is provided for each yarn that facilitates the rapid threading of the winder during set up.

As best illustrated in FIGS. 12–16, the preshrink section 200 is configured to pull the yarn sheet 202 (FIG. 15) from the supply section 100 and preshrink the sheet while maintaining the yarns 102 at an equalized low level of tension. The preshrink section comprises a plurality of vertically orientated cylindrical rollers 204–212 that are rotateably coupled to the framework 214 of the beam winder. First, the yarns sheet 202 is pulled over and around a feed roller 204 and a first heated roller 206. Next, the yarn is wound around a dancer roller 212 of a dancer roller assembly 216 that is coupled with the frame through a pair of lever arms 218. The dancer roller assembly 216 also includes (i) a pneumatic cylinder 220 to supply tension to the yarns 102 of the yarn sheet 202 at the minimum level necessary to prevent them from sagging vertically, and (ii) a linear potentiometer 222, which provides information regarding the position of the dancer roller 212 that is utilized by a controller (not shown) to adjust the speed of one or more of the motors used to turn the various rollers. Finally, the yarn sheet 202 passes over two additional heated rollers 208 and 210 that shrink the yarn sheet 202 before the yarn sheet is pulled into the beam section 300.

As best illustrated in FIGS. 14–16 and 20–22, as the yarn sheet is pulled into the beam section 300, it passes around two cooling rollers 304A and 304B and several small alignment rollers 306 and 308 before being wound onto a beam 302. One of the alignment rollers 306 includes a tensiometer 310 that measures the level of tension in the yarn sheet 202 just before it is wound onto the beam. The information from the tensiometer 310 is used by the controller to control the speed of the beam and to maintain a desired level of tension in the yarn sheet as it is wound onto the beam.

A pivotal turntable 312 is provided for rotating a full beam 302 out of the way while simultaneously rotating a new empty beam 302 into the proper position to receive the yarn sheet 202. Typically, one beam is coupled to a winding motor for pulling the yarn sheet on to it during the beam winding process and the other beam is at rest on the other end of the turntable 312. When the one beam is completely wound the beam winder is momentarily stopped, the yarn sheet 202 is cut and the beams 302 are pivoted on the turntable wherein the new beam can be quickly coupled with the motor so that the winding process may continue. While the new beam is being wound, the operator can switch out the full beam with an empty beam for use during the next switch.

The Yarn Supply Section

Figure 2:
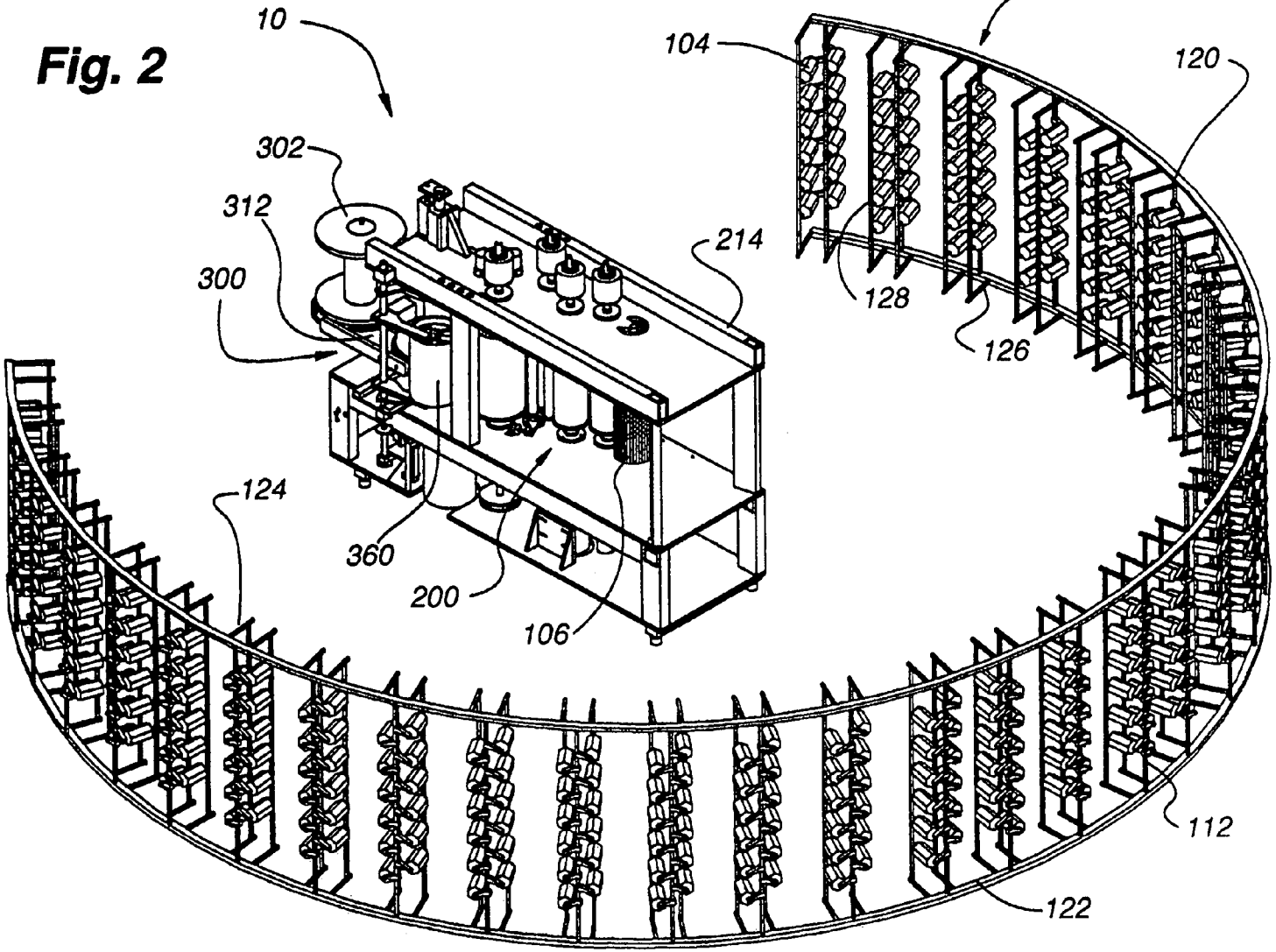
FIG. 2 is an isometric view of the beam winding apparatus with the guide tubes and exhaust hood removed.
Figure 3:
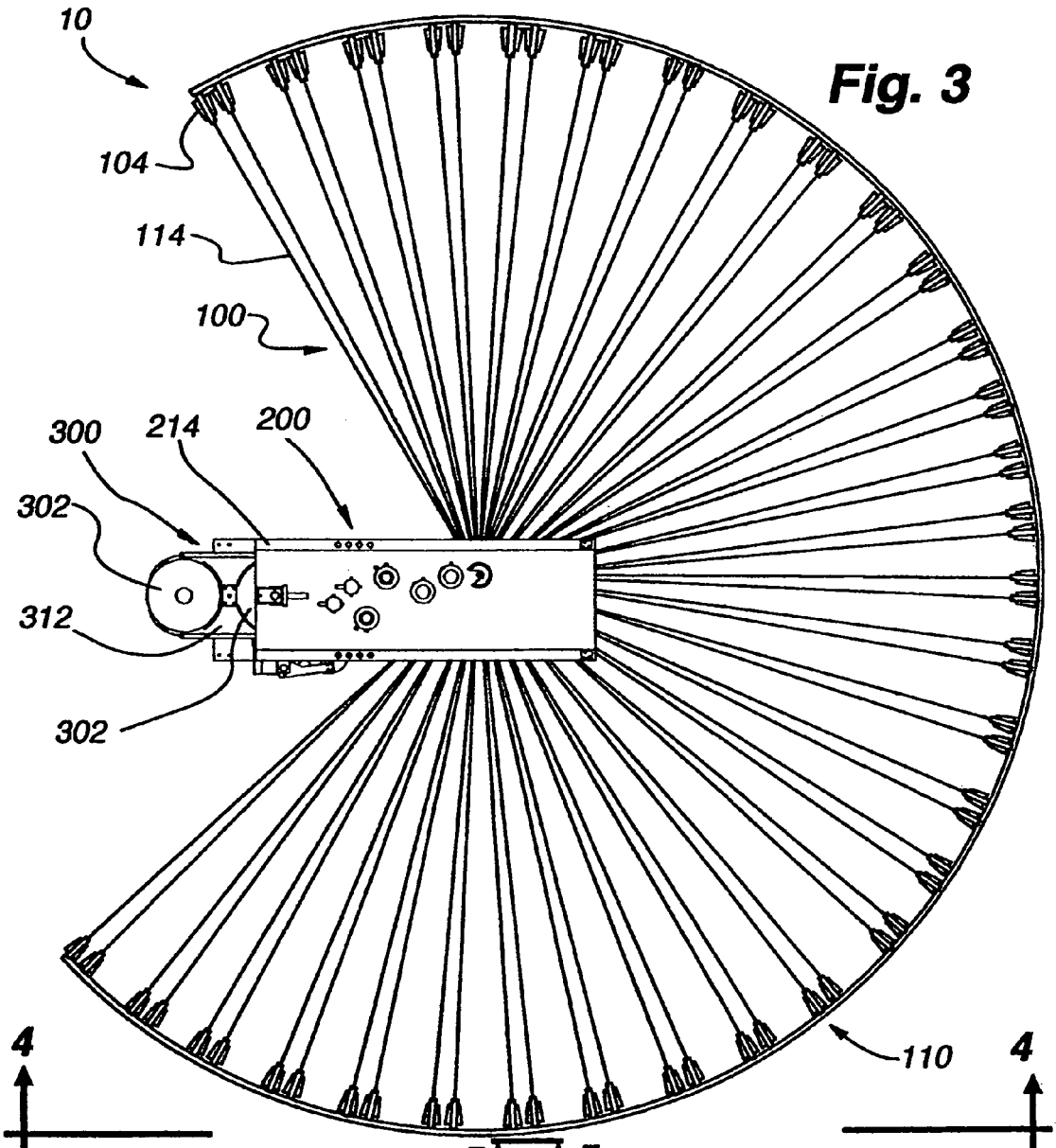
FIG. 3 is a top view of the beam winding apparatus.
Figure 4:
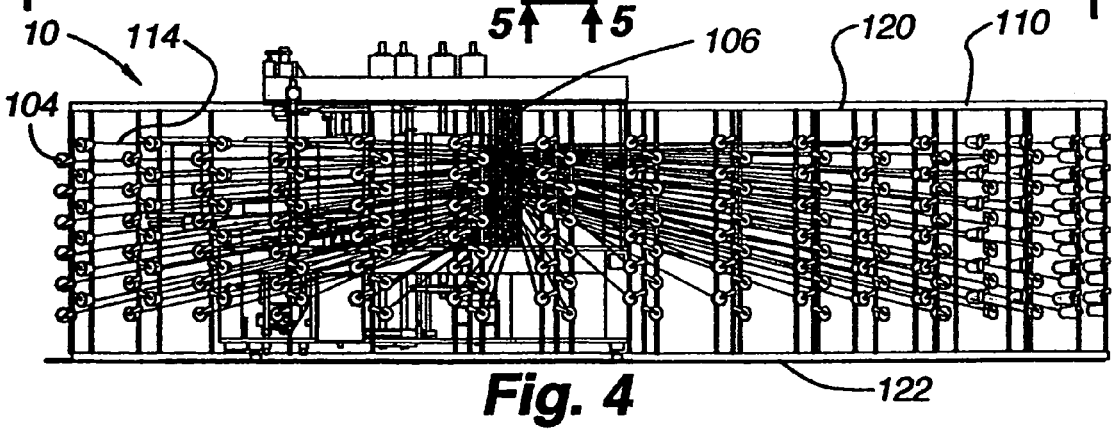
FIG. 4 is a side view of the beam winding apparatus taken along line 4—4 of FIG. 3.

Referring to FIGS. 1 and 2, the spool rack 110 is comprised of a partially arcuate horizontal top and bottom rails 120 and 122 typically fabricated from an aluminum alloy with a plurality (31 in the preferred embodiment) of vertical cylindrical yarn support posts 112 extending between the rails. To the right and left of each support post, upper and lower horizontal feet 124 and 126 extend inwardly from the top and bottom rails. A rigid guide tube support post 128 extends between each pair of feet and is attached to the feet proximate their ends.

Figure 5:
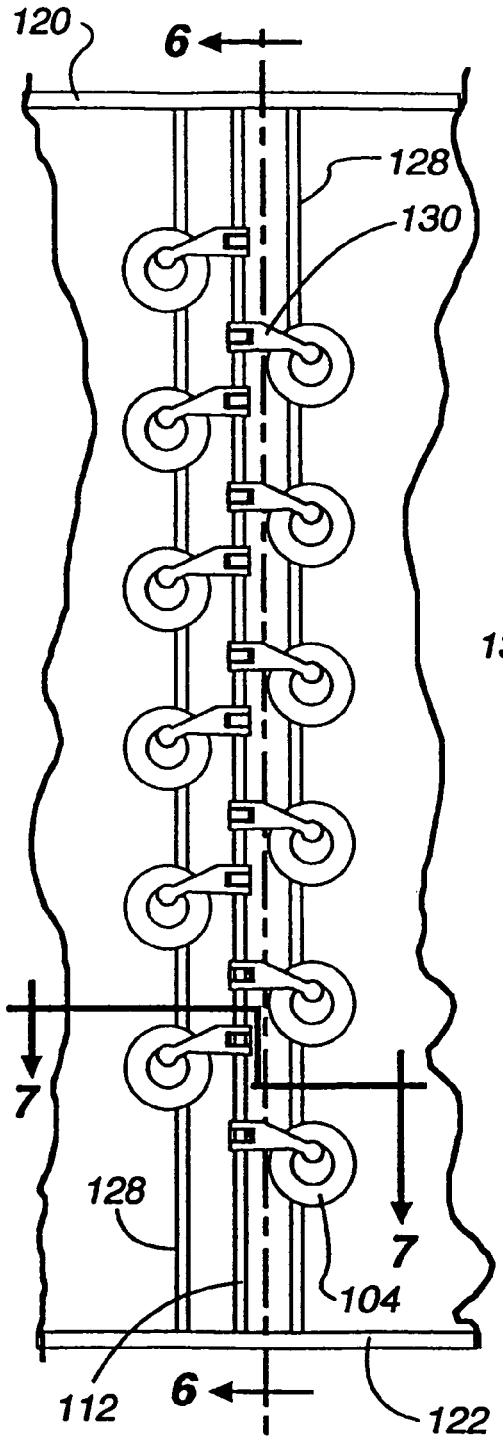
FIG. 5 is a partial view of the spool rack taken along line 5—5 of FIG. 3.
Figure 6:
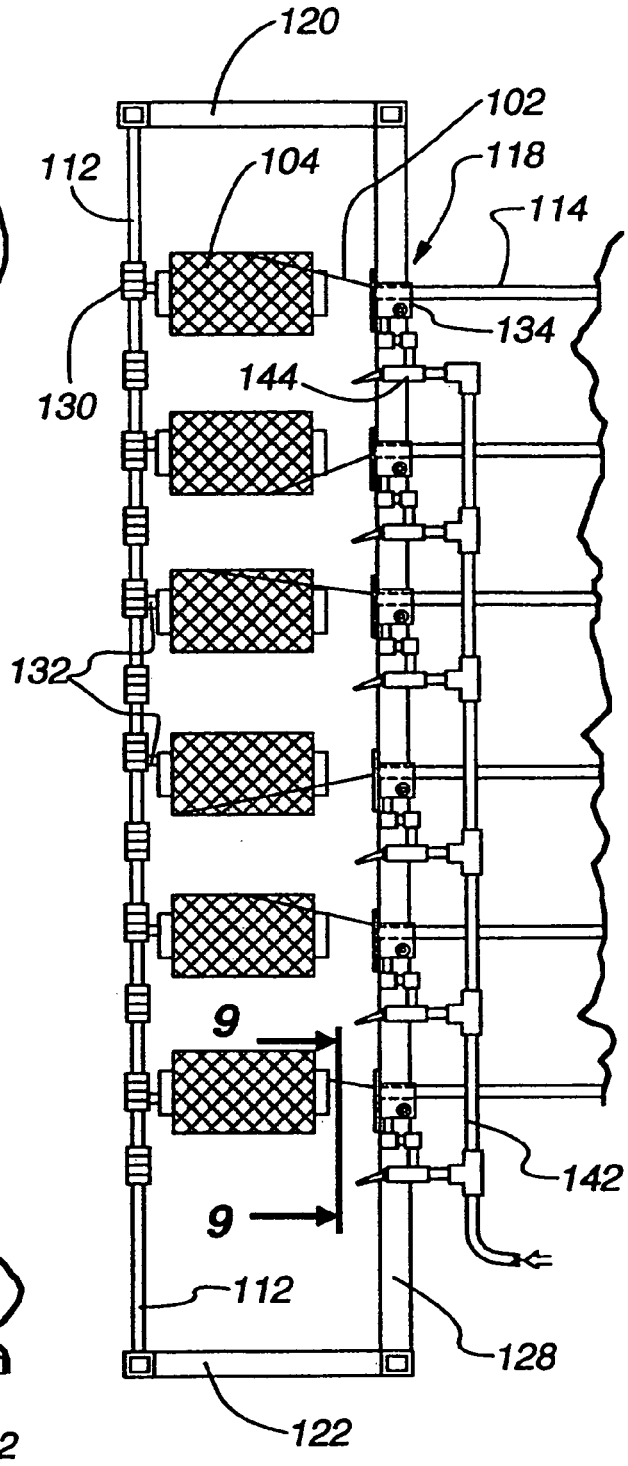
FIG. 6 is a partial view of the spool rack taken along line 6—6 of FIG. 5.
Figure 7:
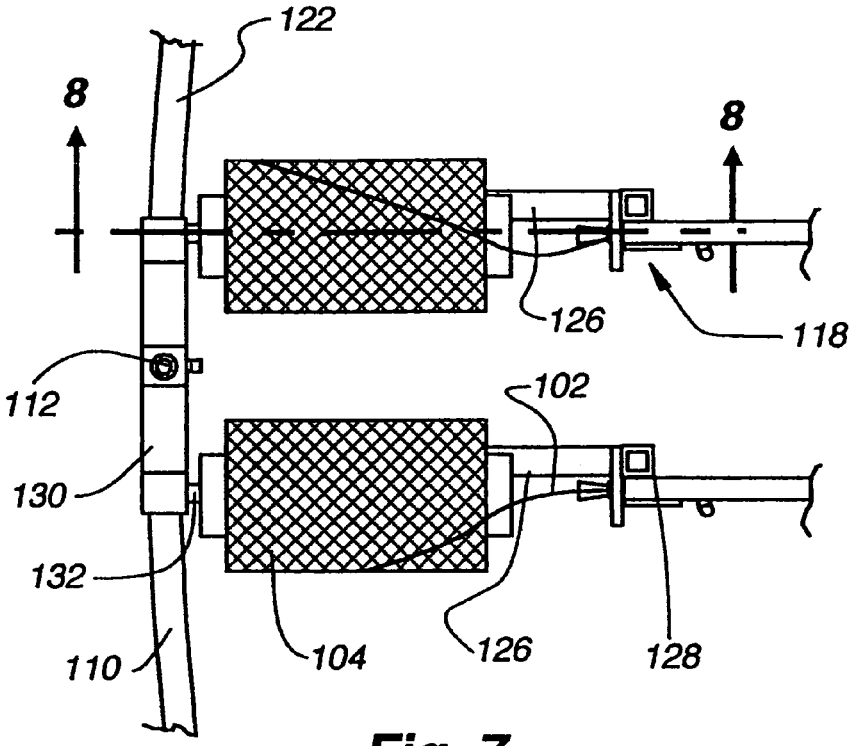
FIG. 7 is top view of two yarn spools on the spool rack taken along line 7—7 of FIG. 5.
Figure 8:
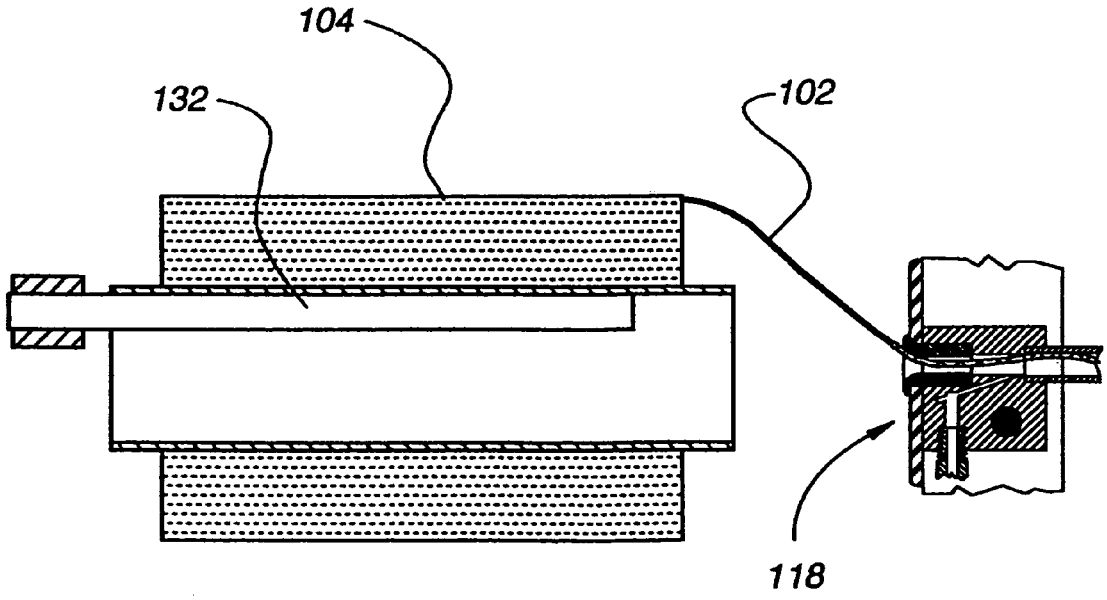
FIG. 8 is a cross sectional view of a yarn spool on the spool rack taken along line 8—8 of FIG. 7.

Referring primarily to FIG. 5, six leftwardly extending and six rightwardly extending spool arms 130 are distributed vertically along and pivotally secured to each yarn support post 112. A shaft 132 is secured to the end of each arm that extends inwardly toward the center axis of the circularly-arced frame as best illustrated in FIGS. 6–8. As shown, a spool of yarn 104 is received over the shaft 132 of each arm 130. Six guide tubes 114 are distributed along each guide tube support shaft 128 and fixed to the shaft through a manifold 134 of a pneumatic feed assembly 118, wherein one open end of each tube faces towards a spool 104 of yarn. The pneumatic feed assembly 118, as shown in FIG. 6, is used to thread an associated yarn 102 through the guide tube 114 and through the proper opening 108 in the comb 106.

Figure 10:
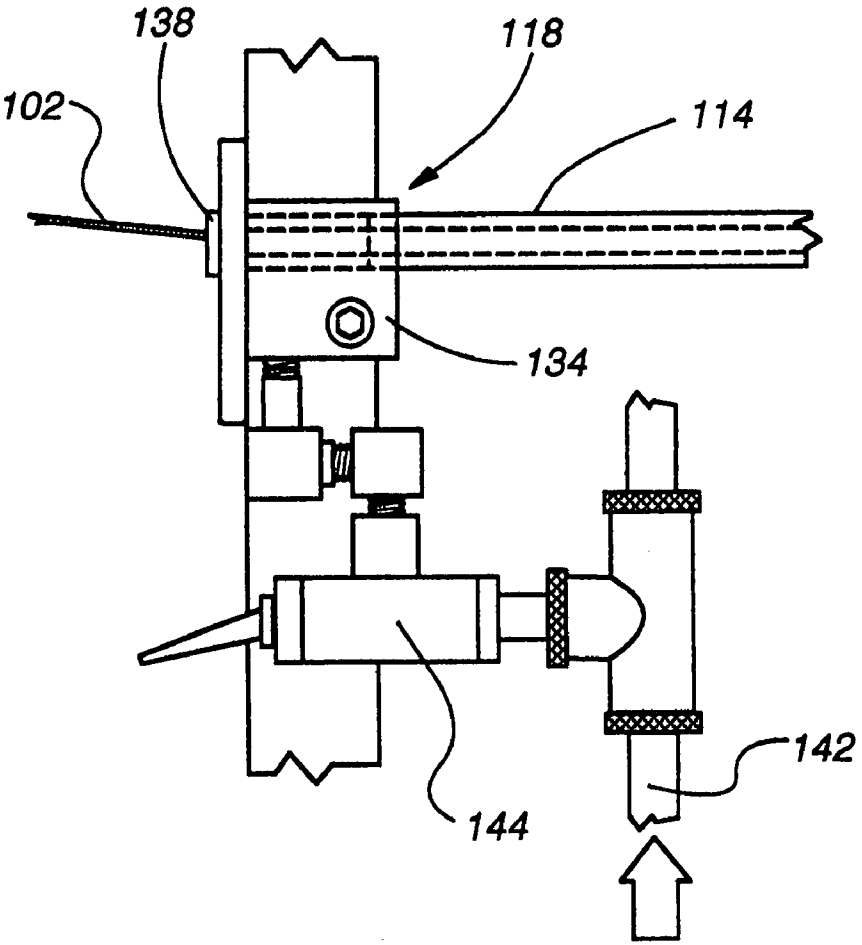
FIG. 10 is a side view of the pneumatic feed assembly taken along line 10—10 of FIG. 9.
Figure 9:
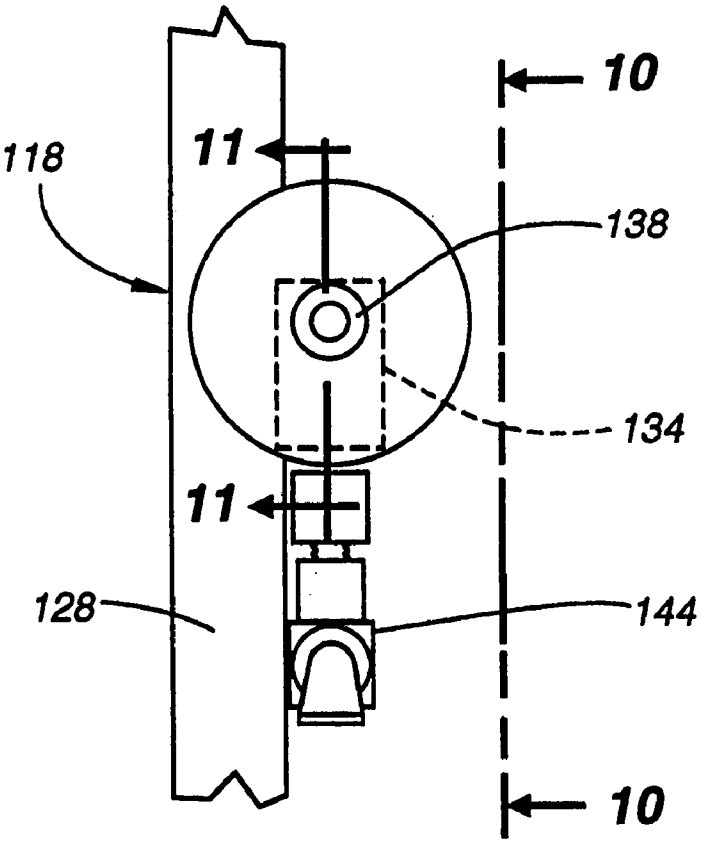
FIG. 9 is a view of the end of a guide tube and the associated pneumatic feed assembly as taken along line 9—9 of FIG. 6.
Figure 11:
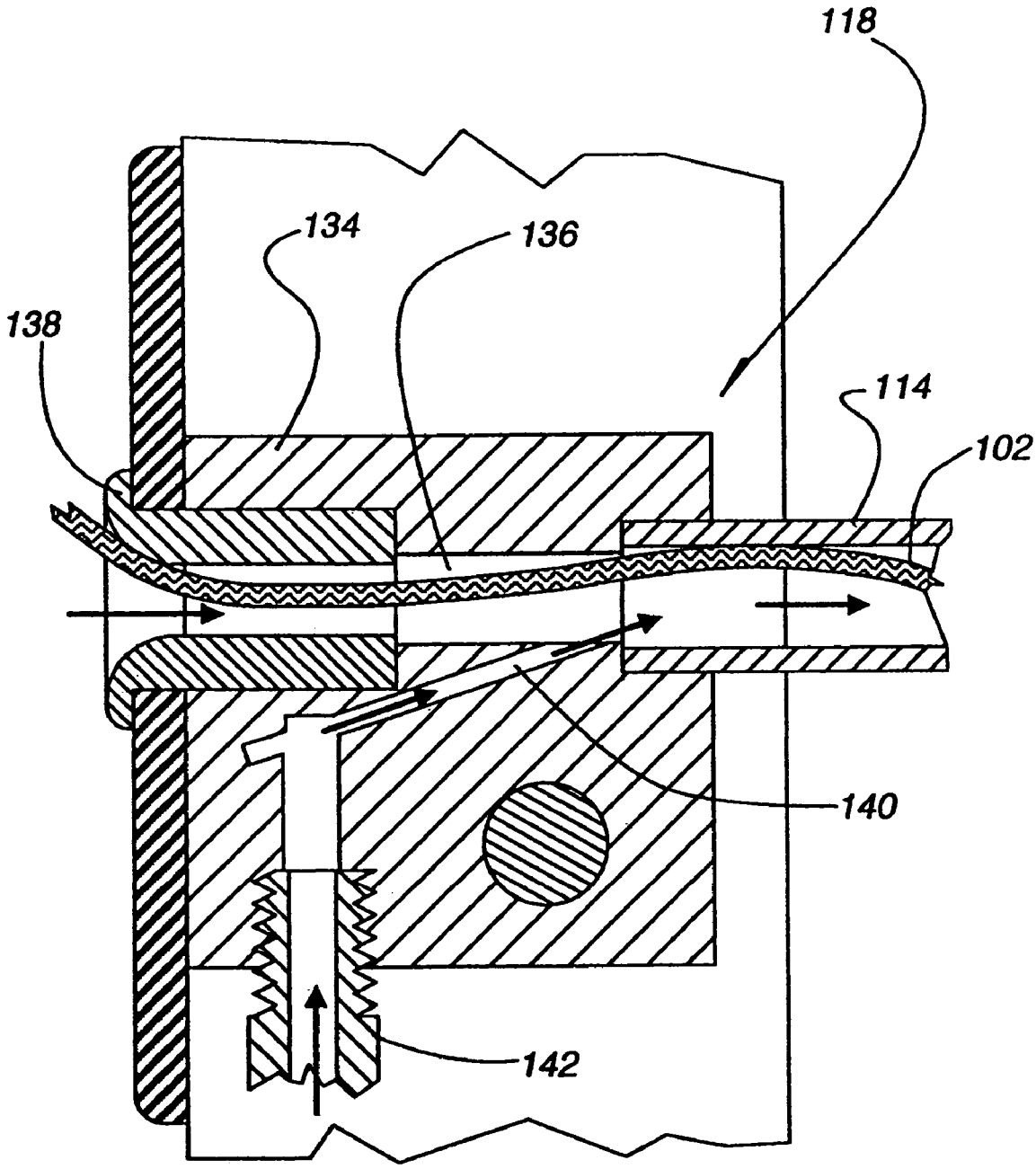
FIG. 11 is a cross sectional view of a manifold of the pneumatic feed assembly taken along line 11—11 of FIG. 9.
Figure 12:
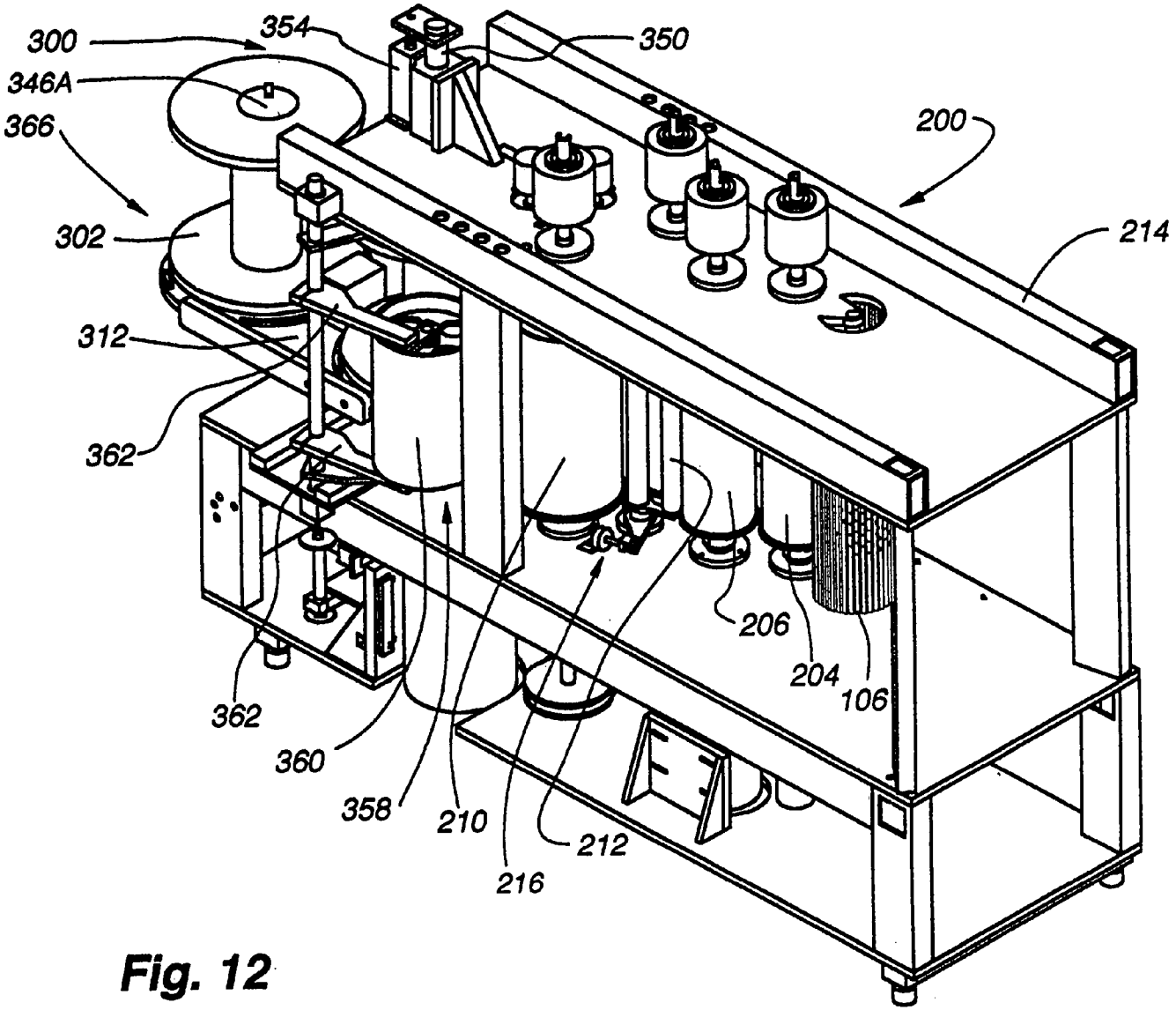
FIG. 12 is a partial isometric view of the beam winding apparatus with the spool rack, guide tubes and exhaust hood removed.

Referring to FIGS. 9–11, the pneumatic feed assembly 118 is shown in greater detail. Each guide tube 114 is received in one end of a bore 136 that passes through the manifold 134. The other end of the bore typically has a plastic bushing 138 received therein and faces an associated spool 102 of yarn to receive the end of the yarn 102 through the bushing 138. The manifold 134 also includes an air supply passageway 140 that intersects with the bore near its right end at an acute angle as shown in FIG. 11. The other end of the passageway 140 is coupled to a pressurized air supply line 142. A pneumatic switch 144 is provided in the air supply line to turn the flow of pressurized air through the manifold off and on.

Operationally, during setup of the beam winder 10, an operator places the end of a yarn 102 in front of the plastic bushing 138 of the manifold 134 and flips the pneumatic switch 144 to send compressed air down the guide tube 114. To the left of the location where the air supply passageway 140 intersects with the manifold bore 136 a vacuum is created by the flow of air to the right of the passageway. The vacuum acts to pull the yarn towards the guide tube. As the yarn passes the air supply passageway, it is carried down the guide tube towards its associated opening 108 in the comb 106 by the flow of air. Once the yarn has been threaded down the tube and through the comb, the supply of compressed air to the tube is switched off, and the process is repeated to thread each yarn of the remaining spools through their associated guide tube.

Figure 17:
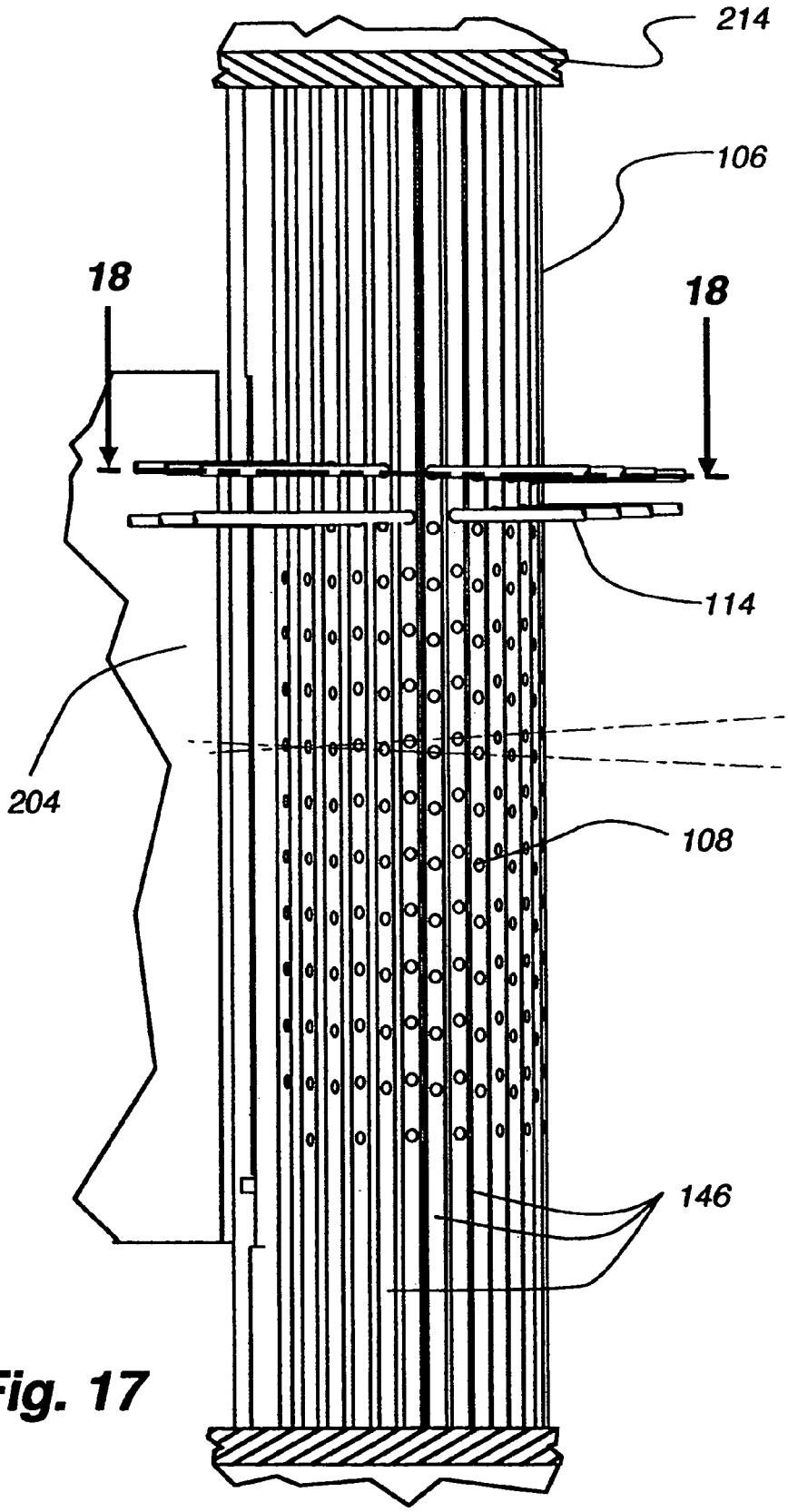
FIG. 17 is a view of the comb taken along line 17—17 of FIG. 15 with only the top row of guide tubes in place.
Figure 18:
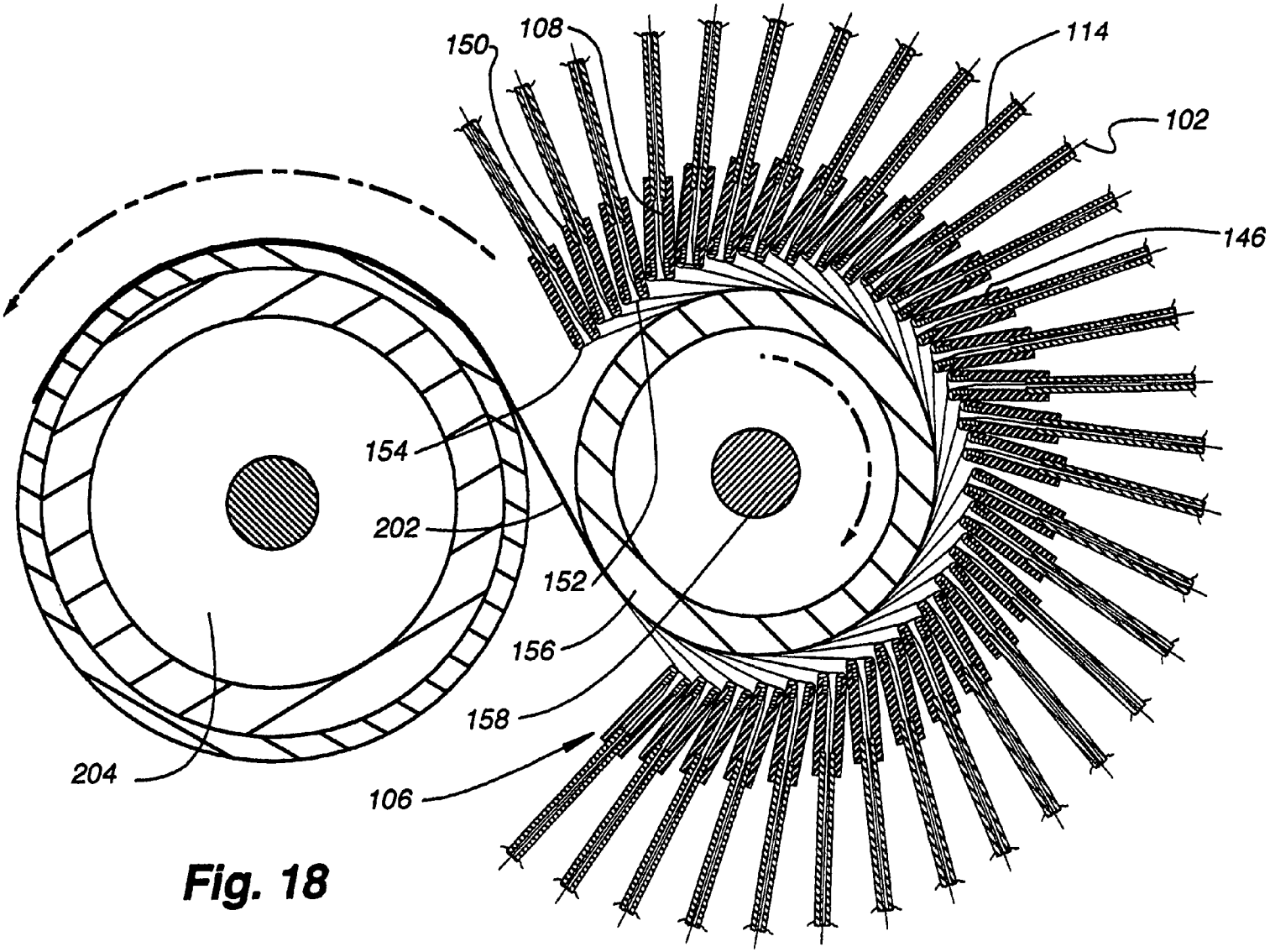
FIG. 18 is a cross sectional view of the comb taken along line 18—18 of FIG. 17.

Referring to FIGS. 14 and 17–19, the circularly-arced comb 106 is illustrated. The comb is comprised of a plurality of individual elongated rectangular bars 146 that each span between the lower and upper horizontal portions of the beam winder framework 214. The number of individual bars 146 is equal to the number of yarn support posts 112 of the spool rack 110. As best shown in FIG. 18, the bars 146 are situated about a gathering roller 148 such that together they have a circularly arced cross section, wherein an outer narrow side 150 of each bar faces generally towards the circularly-arced spool rack 110 and the opposite inner narrow side 152 faces generally towards the gathering roller. In the preferred embodiment, 31 bars are utilized in the comb 106. In alternative embodiments of the invention other comb arrangements can be utilized. For instance, the comb could be comprised of a single curved plate with appropriately situated openings to receive and align the plurality of yarns 102.

Figure 19:
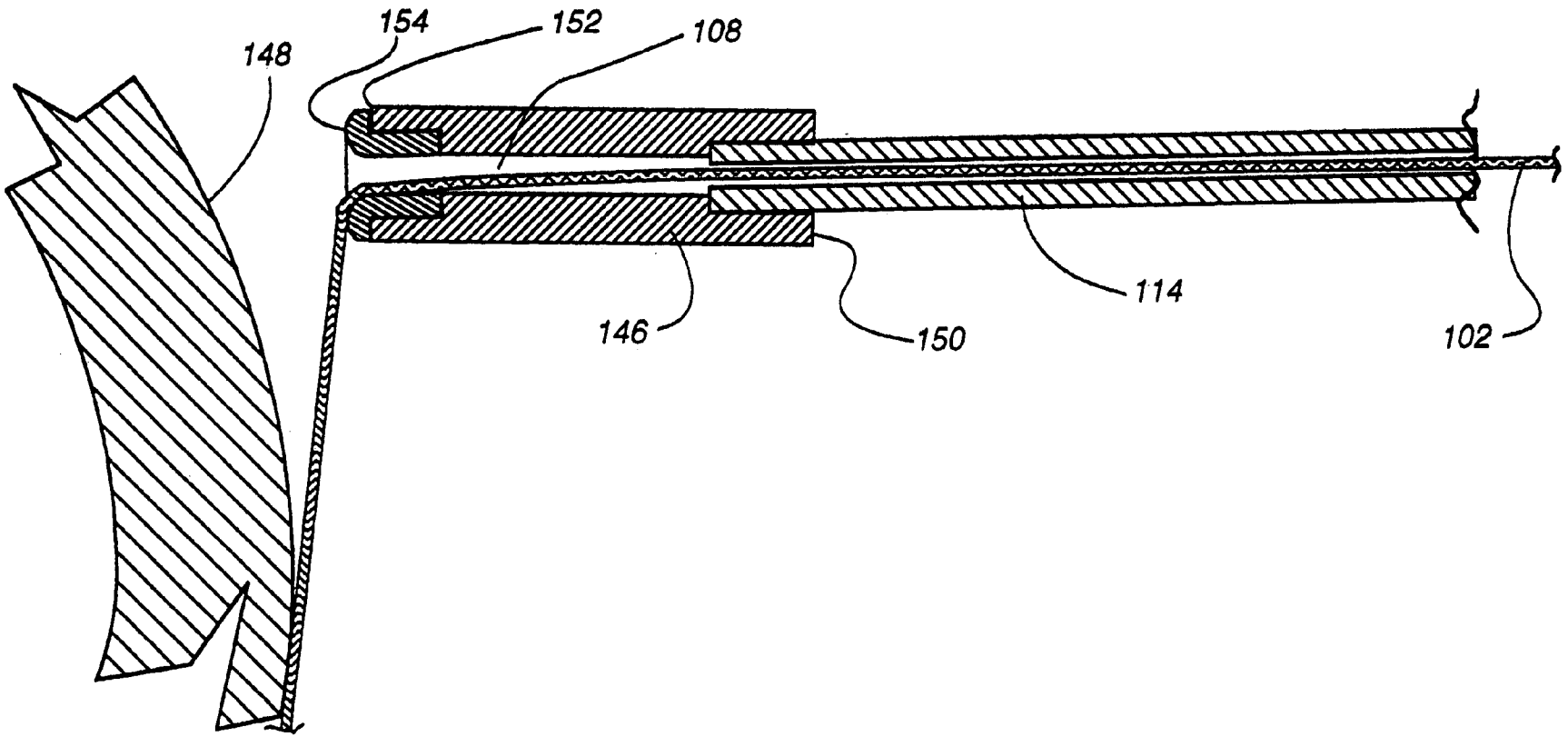
FIG. 19 is a partial cross sectional view taken along line 18—18 of FIG. 17 illustrating a single guide tube and a single elongated rectangular bar of the comb.
Figure 20:
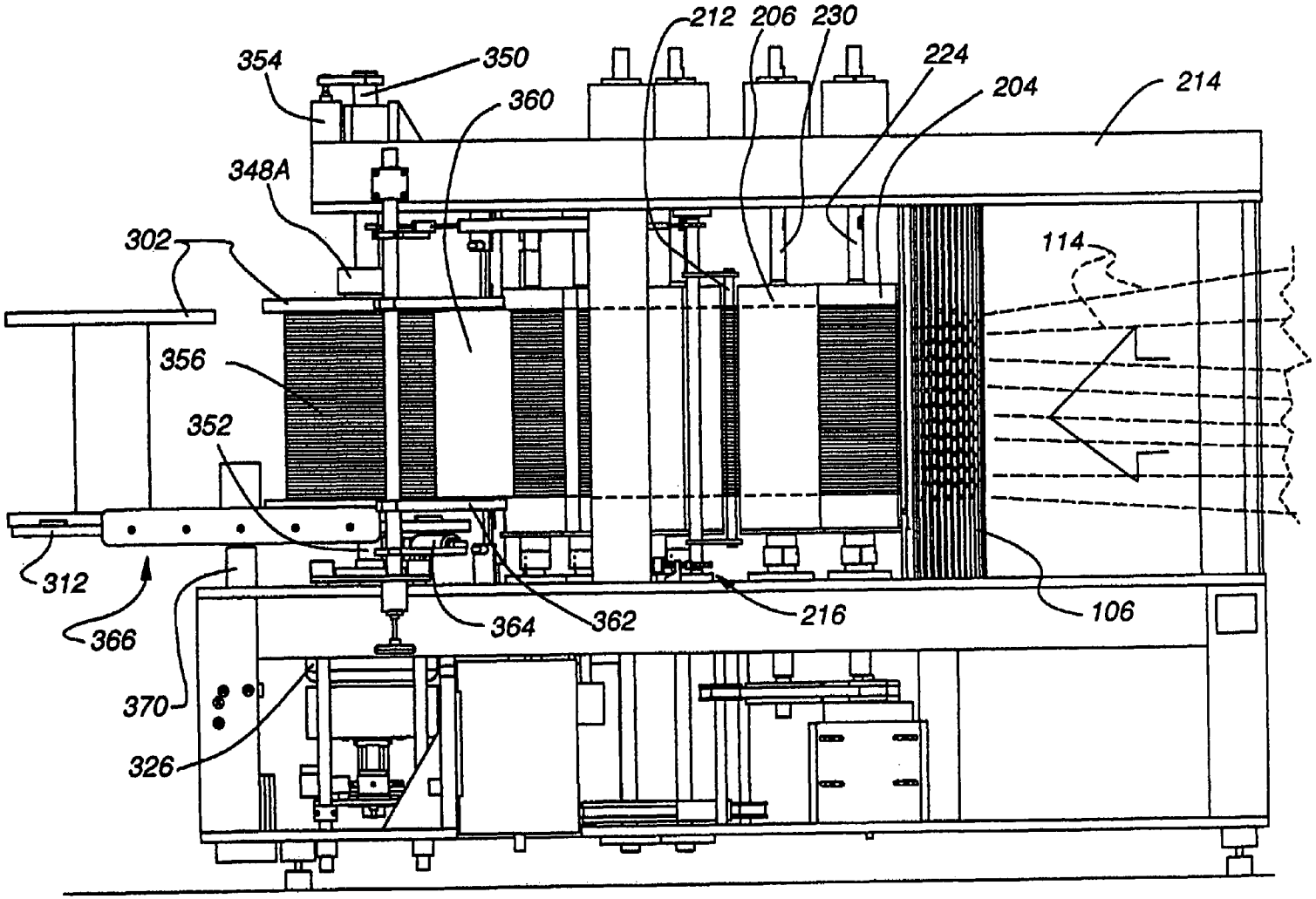
FIG. 20 is a side view of the beam winding apparatus showing the beam engaged with the top and bottom axles.
Figure 21:
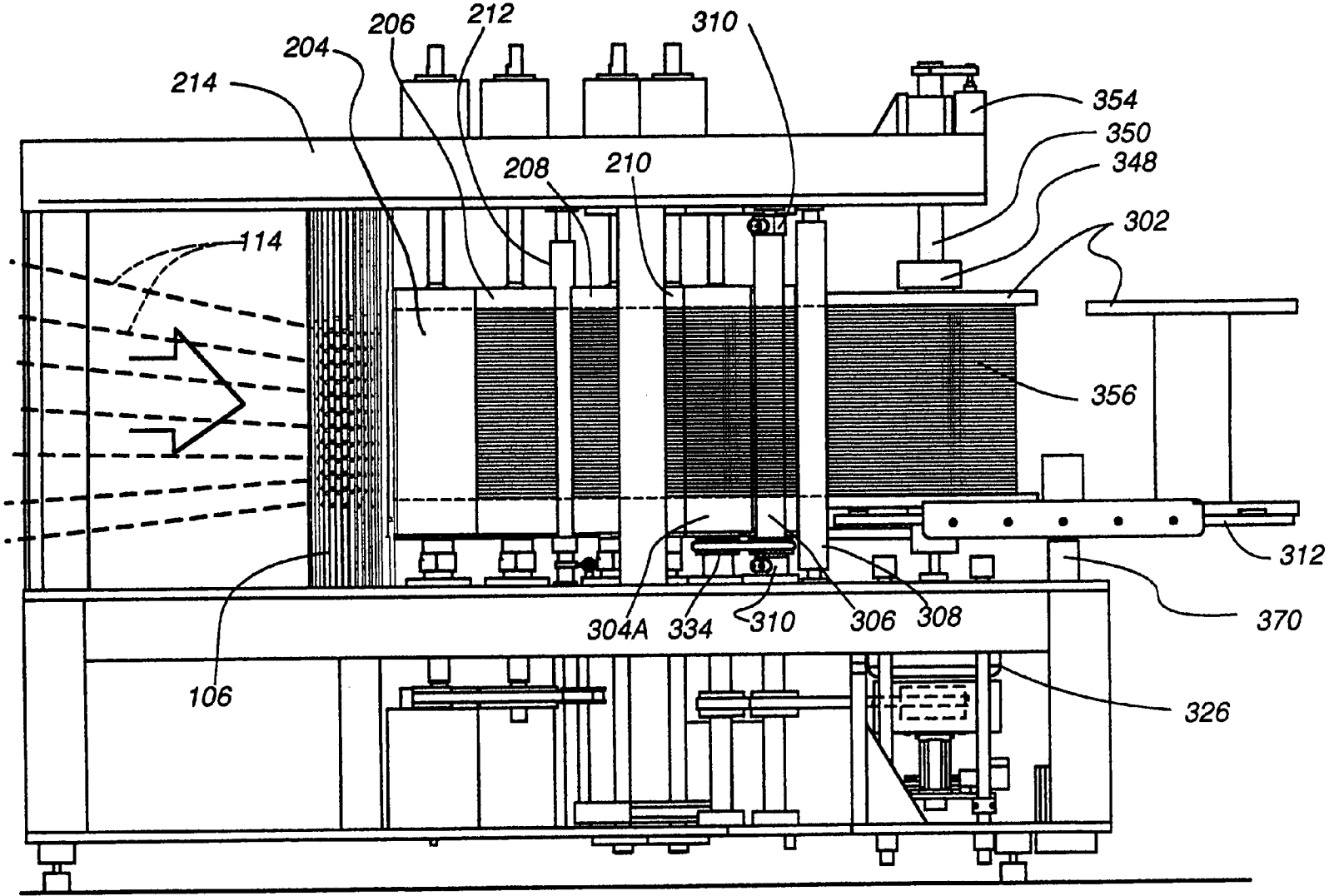
FIG. 21 is an opposite side view of the beam winding apparatus.

Referring to FIGS. 17–19, each bar includes a plurality of vertically-distributed comb openings 108 passing horizontally through it. The openings 108 extend front the outer narrow side 150 where one end of an associated guide tube 114 terminates to the inner narrow side 152 which includes a plastic bushing 154. Each bar 146 is associated with a particular yarn support post 112 of the spool rack with the yarn 102 from the spools 104 of the particular yarn support post passing through the openings 108 by way of associated guide tubes 114. In the preferred embodiment, each bar comprises 12 openings for a total of 372 openings for the entire comb 106. The vertical position of each opening of the 372 is different from that of any of the remaining openings, so that each yarn 102 passing through the comb 106 will have its own vertical position relative to the others in the resulting yarn sheet 202. As each yarn 102 exits its comb opening 108, it is received on the surface of a cylindrical receiving roller 156 as shown in FIGS. 18 and 19.

The receiving roller 156 is partially circumscribed by the arced comb 106 with which it shares a common center axis. The receiving roller is attached to a vertical axle 158. The vertical axle is rotateably coupled to the framework 214 by a pair of bearing assemblies (not shown) permitting the roller 156 to rotate freely. As the yarns 102 are pulled against the roller 156 from downstream, as will be described later, after exiting the comb 106, the planar yarn sheet 202 is formed.

Numerous variations to the yarn supply section 200 are contemplated. For instance, in one variation the air supply manifold is replaced with a vacuum manifold that is located on the guide tubes 114 proximate the comb 106. Instead of blowing the yarn 102 down its associated guide tube, the yarn is pneumatically drawn down the tube. Further, a manifold may be located anywhere along each guide tube, wherein the flow of air creates a vacuum upstream of the manifold. In other variations of the supply section, the tubes can be replaced with channels that support yarns along substantially their entire length between the spool 104 and the comb 106, but have an open side to facilitate setup. Some variations of the supply section do not utilize guide tubes but rely on more traditional eyelets to guide the yarns. Although it is preferred that the distance from each spool of yarn to an associated opening in the comb be the same for all spools of yarn utilized by the beam winder, in certain variations of the supply section (especially those utilizing guide tubes or channels), the distances between spools and the comb can vary. It can be appreciated that where the yarns are adequately supported along their length in a manner that minimizes the level of friction between the supporting guide and the yarn, small to moderate differences in the distance between the yarn spool and the comb will have only a minimal effect in the resulting tension on the yarns. Finally, although the preferred embodiment utilizes a single circularly-arced rack, racks of many configurations may be utilized in variations of the supply section.

The Preshrink Section

Figure 15:
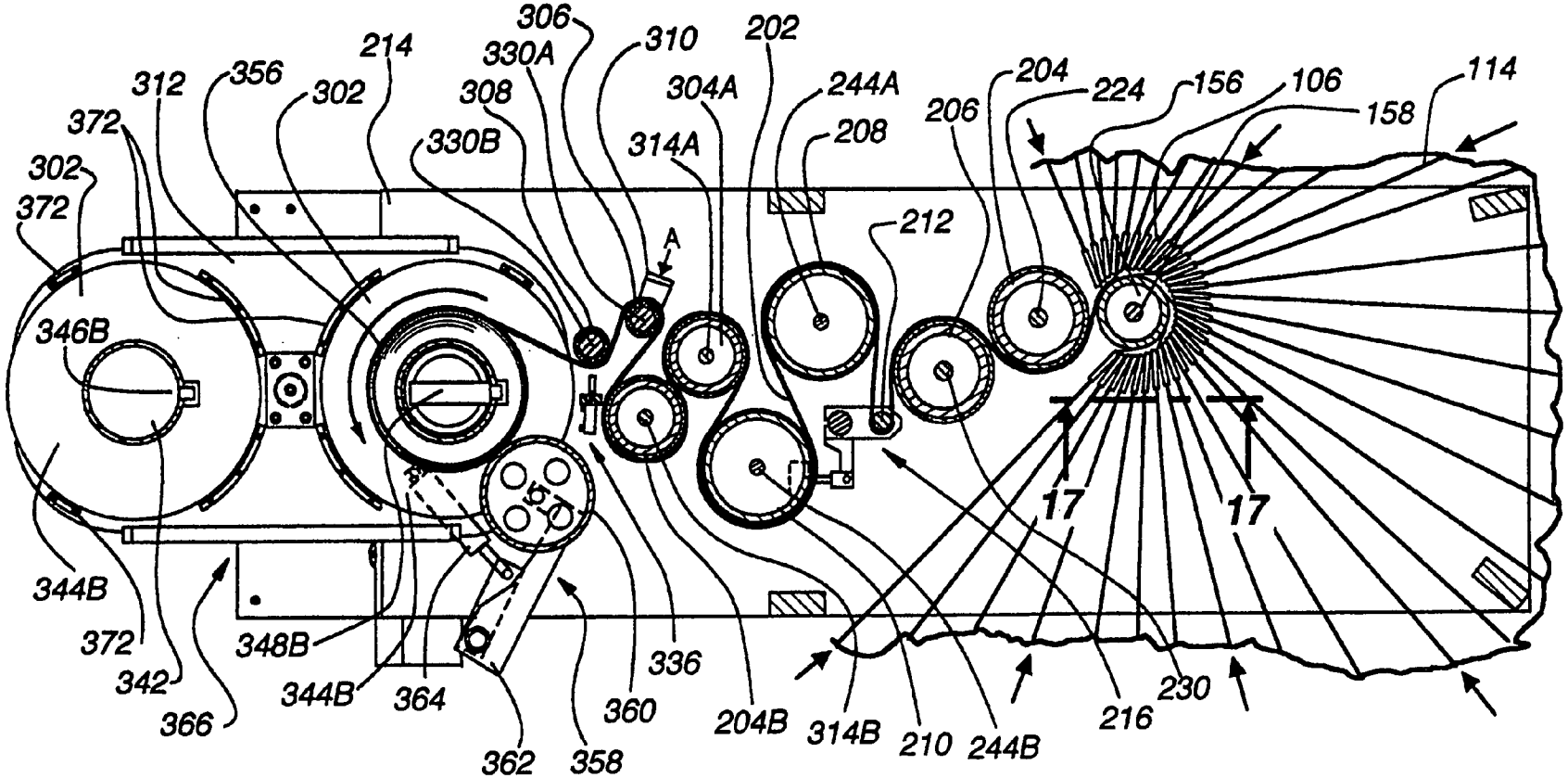
FIG. 15 is a view similar to FIG. 14 showing the path of the yarn sheet.
Figure 16:
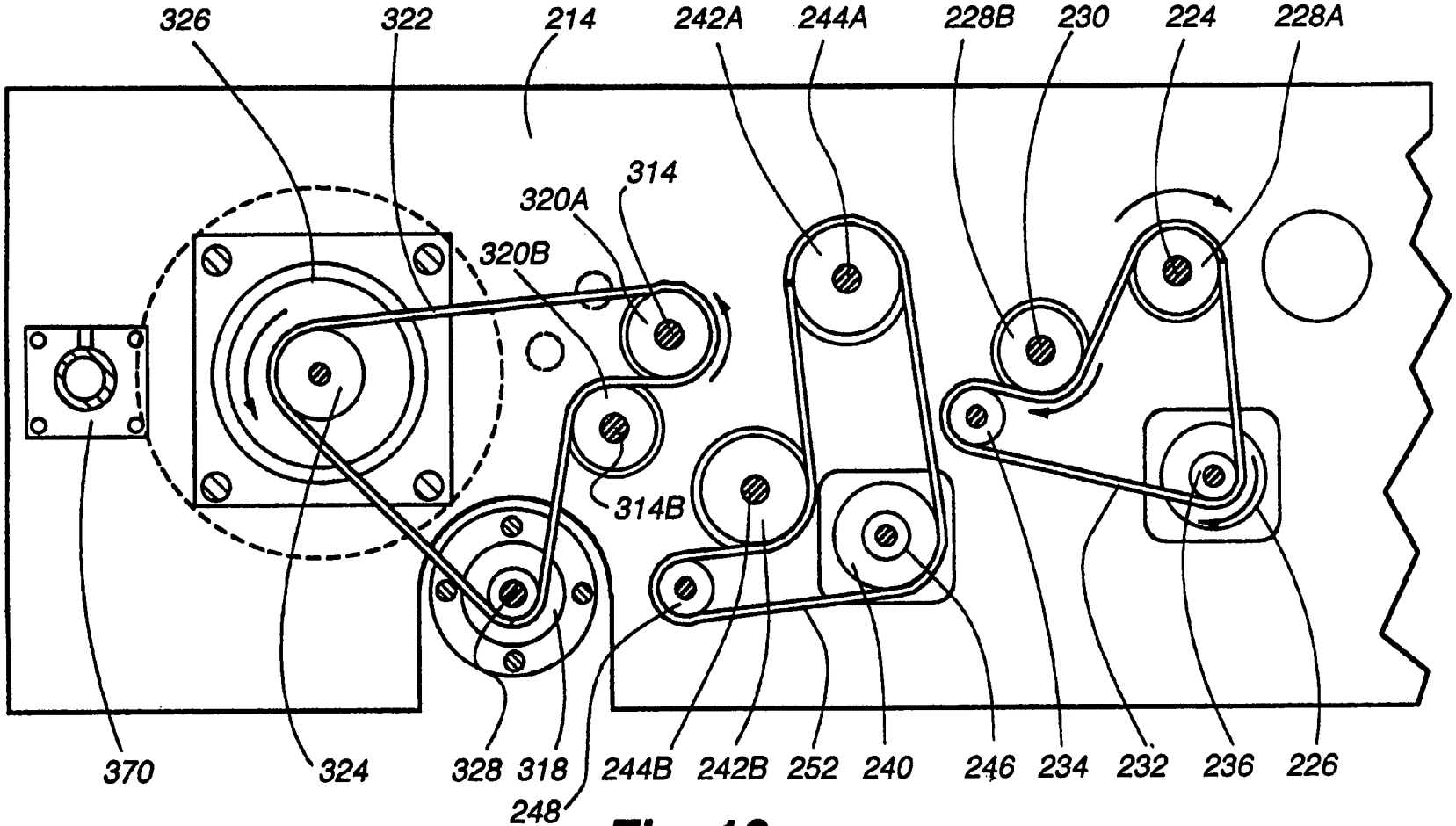
FIG. 16 is a cross sectional view of the beam winding apparatus taken along line 16—16 of FIG. 13.

From the receiving roller 156, the yarn sheet 202 is pulled around a plurality of rollers as it is moved gently towards the beam 302. As best illustrated in FIG. 15, the yarn sheet is first pulled around the feed roller 204 after exiting the receiving roller 150. The feed roller includes an axle 224 that extends vertically above and below the roller and both its top and bottom ends are rotateably attached with the beam winder framework 214 by way of bearing assemblies (not shown). Next, the yarn sheet is pulled around a first heated roller 206 that has the same diameter as the feed roller. As best shown in FIG. 16, both feed roller 204 and the first heated roller 206 are driven by a first stepper motor 226 through pulley wheels attached to the bottom ends of each roller's axle 224 and 230 and a reinforced rubber drive belt 232 that snakes around the pulley wheels 228A and 228B of both rollers 204 and 206, an idler pulley wheel 234 and a pulley wheel 236 attached to the drive shaft of the first stepper motor 226. Referring back to FIG. 15, the feed roller 204 is rotated in a clockwise direction and the first heated roller 206 is rotated in a counterclockwise direction. The first stepper motor 226 is interfaced with a beam winder controller that controls the rotational speed of the rollers 204 and 206 at a rate necessary to match the surface speed of the rollers with the linear speed of the yarn sheet 202 as it is pulled around the rollers. The feed roller and the first heated roller help to pull the yarn through the comb and around the receiving roller.

After the yarn sheet 202 passes over the first heated roller 206, it passes around the small diameter dancer roller 212 of the dancer roller assembly 216. The dancer roller 216 assembly is comprised of a pair of cantilever arms 218 to which the axle of the dancer roller is rotateably secured at one end of each arm 218. The arms 218 are pivotally attached to the beam winder framework 214. A tensioning force is applied to the yarn sheet through the dancer roller by a small pneumatic cylinder 220 that biases the dancer roller 212 away from the first heated roller 206 as shown in FIG. 15. The pneumatic cylinder is attached to one of the cantilever arms 218 at one end and is pivotally attached to the framework 214 at its other end. The dancer roller assembly 216 further includes a linear potentiometer 222 that is also connected to one of the cantilever arms. Movement of the dancer roller either towards or away from the first heated roller 206 from a preferred position causes the potentiometer 222 to send a signal to the controller. The signal is used by the controller to adjust the rotational speed of either the first stepper motor 226 that drives the feed roller 204 and the first heated roller 206 or a second stepper motor 240 that drives the second and third heated rollers 208 and 210 for reasons that will be described below.

After passing around the dancer roller 212, the yarn sheet 202 is passed over and around the second and third heated rollers 208 and 210. The second and third heated rollers are connected to the framework 214 in a similar manner as the feed roller 204 and the first heated roller 206. As shown in FIG. 16, the heated rollers are rotated by the second electric stepper motor 204 by way of pulley wheels 242A and 242B attached to the second and third heated rollers' axles 244A and 244B, a pulley wheel 246 attached to the drive shaft of the second stepper motor 240, a second idler pulley wheel 248 coupled with the framework, and a reinforced rubber drive belt 252 that is snaked around the various pulley wheels. Like with the feed roller 204 and the first heated roller 206, the second and third heated rollers 208 and 210 are rotated at a rate necessary to ensure that the surface speed of the second and third heated rollers match the linear speed of the yarn sheet 202 as it passes over the rollers. The second heated roller 208 is rotated in a counterclockwise direction and the third heated roller 210 is rotated in a clockwise direction.

The surfaces of the three heated rollers 206, 208, and 210 are typically heated by electric resistance heaters (not shown) contained within the rollers, although any suitable manner of heating the rollers can be utilized. The first heated roller 206 is maintained at a first elevated temperature and the second heated roller 208 is maintained at a second elevated temperature that is higher than the first elevated temperature. The third heated roller 210 is maintained at a third elevated temperature that is higher than the second elevated temperature. Typically, the first elevated temperature is low enough that no shrinkage of the yarn sheet 202 occurs as the sheet passes over the first heated roller. Typically, the purpose of the first heated roller is to just preheat the yarn sheet. Some shrinkage of the yarn sheet may occur as the yarn sheet passes over the second heated roller 208, but the majority of shrinkage will occur as the sheet passes over the third heated roller 210 that is maintained at the highest temperature.

The temperatures utilized are dependent on the type of yarn being wound. Yarns comprised of different materials need to be exposed to different temperatures to be properly and fully preshrunk. In one embodiment, where a polyester yarn is utilized a maximum third elevated temperature of around 450 degrees Fahrenheit is utilized. This temperature is very close to the melting point of the polyester and causes the filaments that comprise the yarn to relax and contract (any exposed ends of the filaments along the outer surface may melt). At normal operating speeds (in excess of 900 ft/minute) the yarn is in contact with the heated rollers 206, 208 and 210 for an extremely brief period of time and does not completely heat up to the third elevated temperature as it passes over the third heated roller. Rather, the maximum temperature achieved by the yarn is some fraction of the third elevated temperature.

Because of the low tension applied to the yarn sheet 202 as a result of the use of the guide tubes 114 for each yarn 102 and the driven feed and heated rollers, the yarn can retract and shrink a significant amount during the preshrink operation. When a tension force greater than a threshold level is applied to a yarn, the yarn will typically extend or stretch. As a yarn is heated above threshold temperature, a shrinkage force is typically created as the yarn is encouraged towards a state of greater entropy (for instance, the aligned filaments of a spun yarn tend to contract to a less aligned or less ordered configuration). At or above the threshold elevated temperature, the tension force necessary to stretch or plastically deform the yarn is significantly decreased. Accordingly, a heated yarn of a yarn sheet will only shrink when the heat induced shrinkage force is greater than the counteracting externally applied tension force. As the yarn shrinks the magnitude of the shrinkage force decreases until the shrinkage force is the same as the counteracting tension force and the yarn can no longer shrink. By maintaining the tension in the yarn sheet at the lowest possible level, the yarns can shrink more than yarns that are being pulled at a greater tension. It is to be understood that a certain minimum level of tension (as applied to the yarn sheet by the dancer assembly 216) is required to hold the yarns horizontally straight with minimal vertical sagging caused by gravity.

If the tension varies from yarn to yarn in the yarn sheet 202, the amount that each individual yarn shrinks during the preshrink process can be different resulting in the potential problems mentioned above when the yarn sheet is utilized to fabricate non-woven fabrics. The use of guide tubes 214 and spool racks 210 that equalize the tension force needed to unwind each yarn from its spool help to ensure that all the yarns are uniformly shrunk during the preshrink operation. Accordingly, any residual shrinkage occurring in a later operation during the fabrication of a non-woven fabric is both minimal and relatively uniform among all the yarns of the yarn sheet.

It can be appreciated that as the yarn sheet 202 is shrunk, the linear speed at which the shrunk yarn sheet is transported through the beam winder apparatus must be slower than the linear speed of the yarn sheet before shrinkage if the tension of the yarn sheet through the preshrink section 200 is to be maintained at a constant level. For example, if the yarns 102 are unwound from their spools 104 and pulled through the comb 106 at 950 ft/minute, and the yarns shrink about 5% as they are pulled over the third heated roller 210, the linear speed of the yarn sheet 202 after shrinkage should be about 903 ft/minute to maintain the level of tension of the yarn sheet before and after shrinkage. If the linear speed of the yarn sheet after shrinkage is too fast, the tension level of the yarn sheet will increase beyond the preferred minimal levels effectively reducing the magnitude of amount of shrinkage imparted during the beam winding operation. Conversely, if the linear speed of the yarn sheet after shrinkage is too slow, the tension will be relieved to below the minimum level and the yarns 102 will have a tendency to sag and slide downwardly onto the rollers, destroying the integrity of the yarn sheet.

In the preferred embodiment of the beam winder, the dancer assembly 216 acts through the dancer roller 212 to supply the necessary amount of tension to the yarn sheet and provide information to the controller to control the relative linear speeds of the yarn sheet before and after shrinkage. The movement of the roller 212 on the cantilever arms 218 indicates variations in the correct speed ratios of the rollers 204, 206 and 210 on either side of the dancer roller. If the linear speed of the second and third heated rollers are too high relative to the linear speed of the feed roller 204 and first heated roller 206, the dancer roller 212 will move towards the first heated roller (as seen in FIG. 15). On the other hand, if the linear speed of the second and third heated rollers 208 and 210 is too slow relative to the linear speed of the feed roller 204 and the first heated roller 206, the dancer roller 212 will move away from the first heated roller 206. The potentiometer 222 of the dancer assembly 216 measures the movement of the dancer roller 212 and signals the information to the beam winder controller. Responsive to this signal the controller varies the speeds of the first and second servo motors 226 and 240 as necessary to maintain the dancer roller in a position at or near the middle of its range of travel. In one embodiment, the controller adjusts the speed of the first servo motor 226 to maintain the positioning of the dancer roller and the second servo motor 240 is maintained at a generally constant speed. In another embodiment, the controller adjusts the speed of the second servo motor 240 to maintain the positioning of the dancer roller and the first servo motor 226 is maintained at a relatively constant speed. Other embodiments are also envisioned wherein the controller varies the speeds of both servo motors as necessary to maintain the dancer roller in its preferred position.

The preshrink section described above is merely exemplary, and there are numerous possible variations to the preshrink section that remain within the scope of the invention as described in the appended claims. For instance, there are many suitable variations to the various rollers utilized therein. In one alternative embodiment, more or less than three heated rollers may be utilized. The diameters of the rollers may vary as well depending on the configuration of the preshrink section with the size of their pulley wheels being adjusted to maintain the proper relative linear speeds of the yarn sheet. In other embodiments, other types of heaters can be utilized. For instance, an oven may be utilized through which the yarn sheet passes or a stream of hot air may be directed onto the yarn sheet.

The Beam Section

After exiting the third heated roller 210, the pre-shrunk yarn sheet 202 is passed over and around a pair of cooling rollers 304A and 304B (FIG. 14) that cool the yarn sheet and stabilize it. It is to be appreciated that at an elevated temperature, the tension force necessary to stretch (or plastically deform) the yarns of the yarn sheet is less than when the yarn is at room temperature. Accordingly, any tension applied to the yarn sheet as it is pulled onto the beam 302 could re-stretch it if it is allowed to remain at an elevated temperature. Accordingly the cooling rollers are utilized. Each cooling roller is rotateably attached to the framework through bearing assemblies through which the rollers' axles 314A and 314B pass at their top and bottom ends. The axles 314A and 314B of the cooling rollers are hollow and are coupled with hoses 316 that supply and pass water through the interior of the rollers to cool them.

The cooling rollers 304A and 304B are typically fabricated of aluminum or some other metallic material that can transfer heat effectively. The surfaces of the rollers are coated with a non-stick material, such as PFTE, to prevent any material on the surface of the yarn that may have melted as it was pulled over the third heated roller 210 from sticking to the cooling rollers. Additionally, the cooling rollers' surfaces are roughened somewhat, such as would be imparted by a bead or sandblast, to help hold the yarn sheet 202 against them, and prevent the yarns from sliding along them at a rate greater than the linear speed of the rollers' surfaces for reasons that are described below.

Both cooling rollers 304A and 304B are driven by a common third stepper motor 318 by way of pulley wheels 320A and 320B attached to the bottom ends of each roller's axle 314A and 314B and a reinforced rubber drive belt 322 that snakes around the pulley wheels of both rollers, a pulley wheel 324 attached to a magnetic clutch 326 of the beam drive mechanism and a pulley wheel 328 attached to the drive shaft of the third stepper motor (as best shown in FIG. 16). Referring back to FIG. 15, the first cooling roller 304 A is rotated in a counterclockwise direction and the second cooling roller 304 B is rotated in a clockwise direction. Like the first and second stepper motors, the third stepper motor 318 is interfaced with the beam winder controller that maintains the rotational speed of the cooling rollers at a rate that matches the surface speed of the rollers with the linear speed of the yarn sheet 202 as it is pulled around the rollers. Typically, the cooling rollers are rotated at a rate that matches their surface speed with the surface speed of the second and third heated rollers 208 and 210.

Next, the yarn sheet passes around a pair of small diameter alignment rollers 306 and 308 which are rotateably attached to the framework via their axles 330A and 330B and bearing assemblies. The alignment rollers 306 and 308 act to position the yarn sheet 202 for winding onto the beam 302. The first alignment roller 306 is coupled with a tensiometer 310 that measures the forces induced on the roller in the direction of line A (as shown in FIG. 15) as the yarn sheet is pulled around the roller 306. The force measurements are utilized by the controller to determine the tension level in the yarn sheet for reasons discussed in greater detail below. In one embodiment of the beam winder, the first alignment roller 304 is coupled with the first cooling roller 304 A via an elastometric drive belt 334 that acts to actively spin the first alignment roller. In general, the first alignment roller is rotated to reduce the friction between the roller and the yarn sheet, and it is not intended to pull the yarn sheet over its surface. In one embodiment,.the surface speed of the roller 306 is significantly less than the linear speed of the yarn sheet. In other embodiments, no drive belt connection is made and the first alignment roller spins freely.

Figure 14:
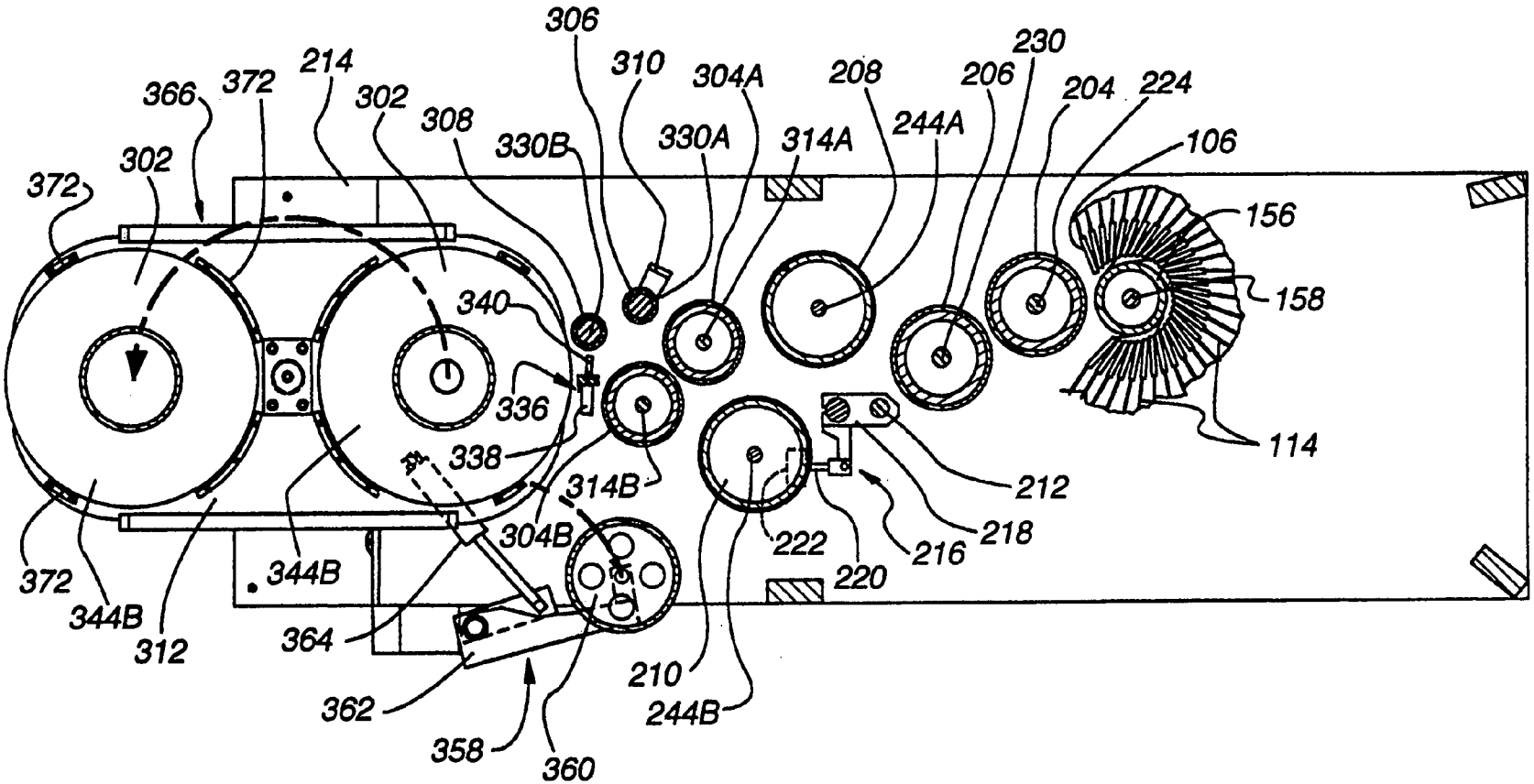
FIG. 14 is a cut away view of the beam winding apparatus taken long line 14—14 of FIG. 13 also illustrating the guide tubes extending from the comb.

Referring to FIG. 14, a pneumatic clamp assembly 336 is provided to hold the yarn sheet 202 in place while a full beam 302 is replaced with an empty beam 302. The pneumatic clamp assembly 336 includes one or two pneumatic cylinders 338 that are mounted to the beam winder framework 214, and an elongated vertically orientated bar 340 that extends substantially the entire length of the second alignment roller 308. The elongated bar 340 is mounted to the shafts of the pneumatic cylinders 338 to facilitate movement between a retracted position and an engaged position wherein a front edge of the bar is biased against the surface of the second alignment roller. In one embodiment the front edge of the clamp bar is rounded to prevent any possibility that the clamp bar will cut one or more yarns 102 of the yarn sheet 202 when it is engaged. In another embodiment, the front edge of the bar has a rubber material affixed to its surface to protect the yarns of the yarn sheet. Operationally, the clamp bar 340 is engaged after the beam winder has been stopped to replace a full beam 302 with an empty beam 302 but before the yarn sheet 202 is cut. The engaged clamp bar holds the aligned yarn sheet in place until a new beam is in place and ready to receive the yarn sheet.

Figure 13:
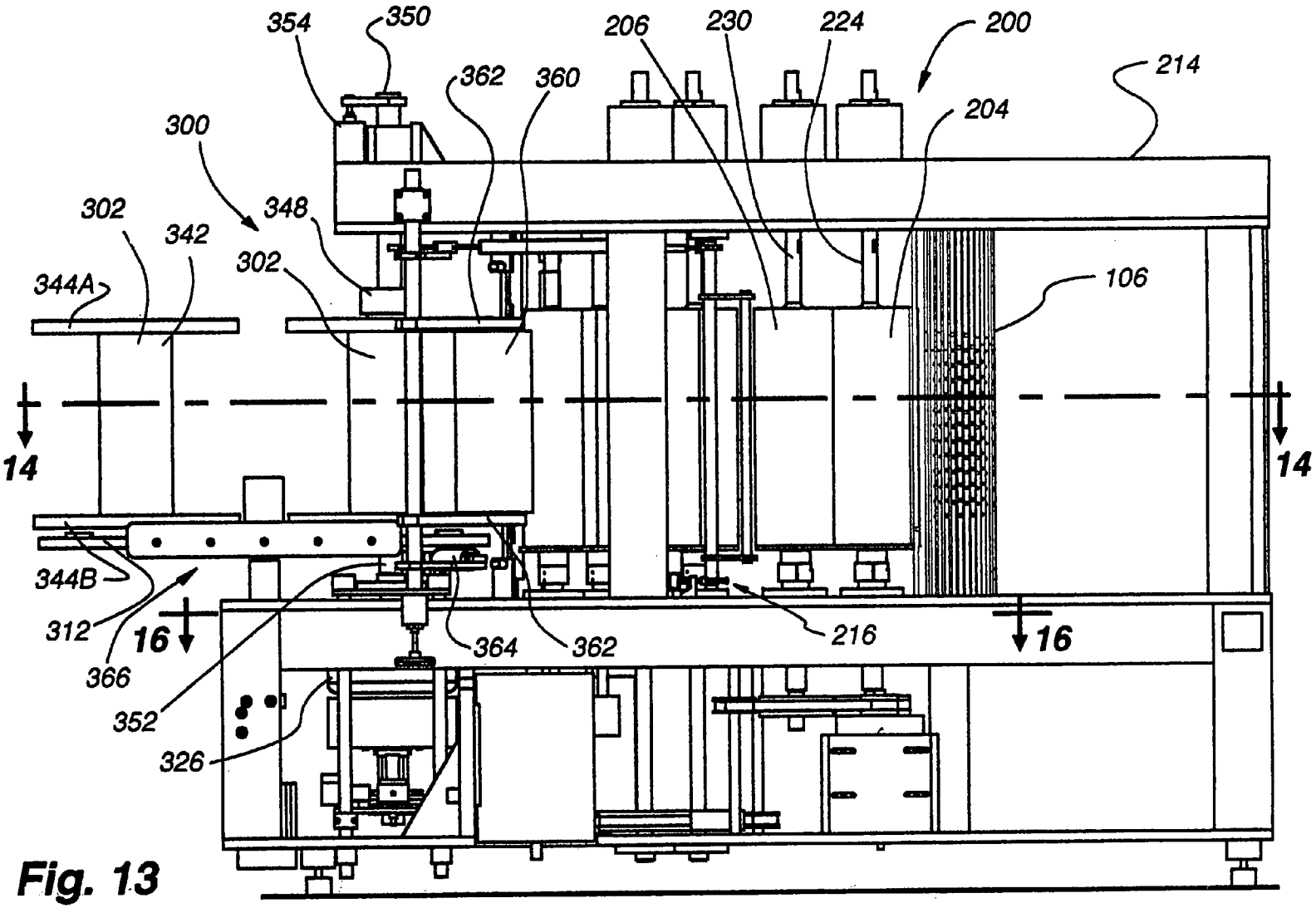
FIG. 13 is a side view of the beam winding apparatus with the spool rack, guide tubes and exhaust hood removed.
Figure 22:
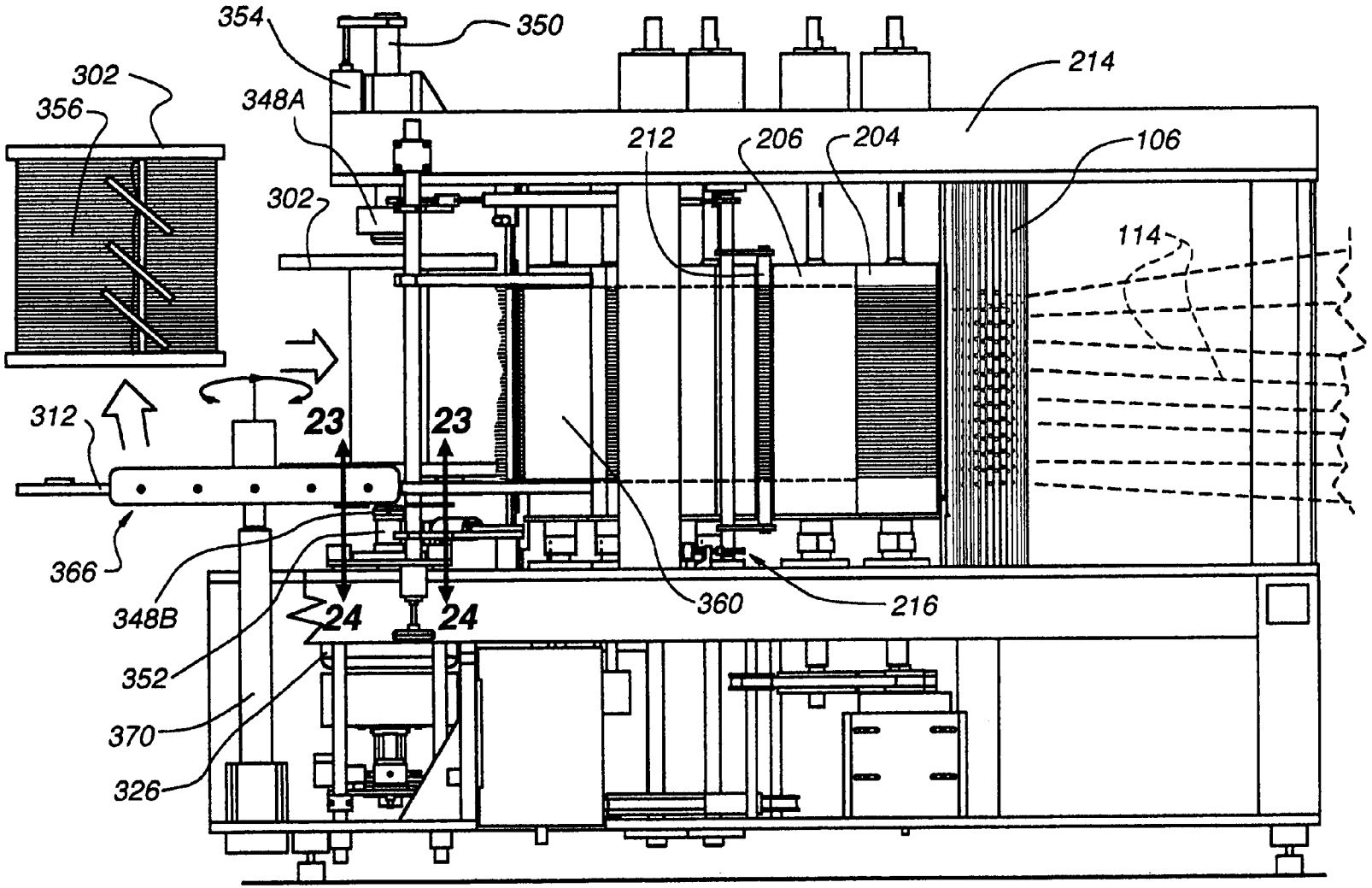
FIG. 22 is a side view of the beam winding apparatus showing the beam disengaged from the top and bottom axles.
Figure 23:
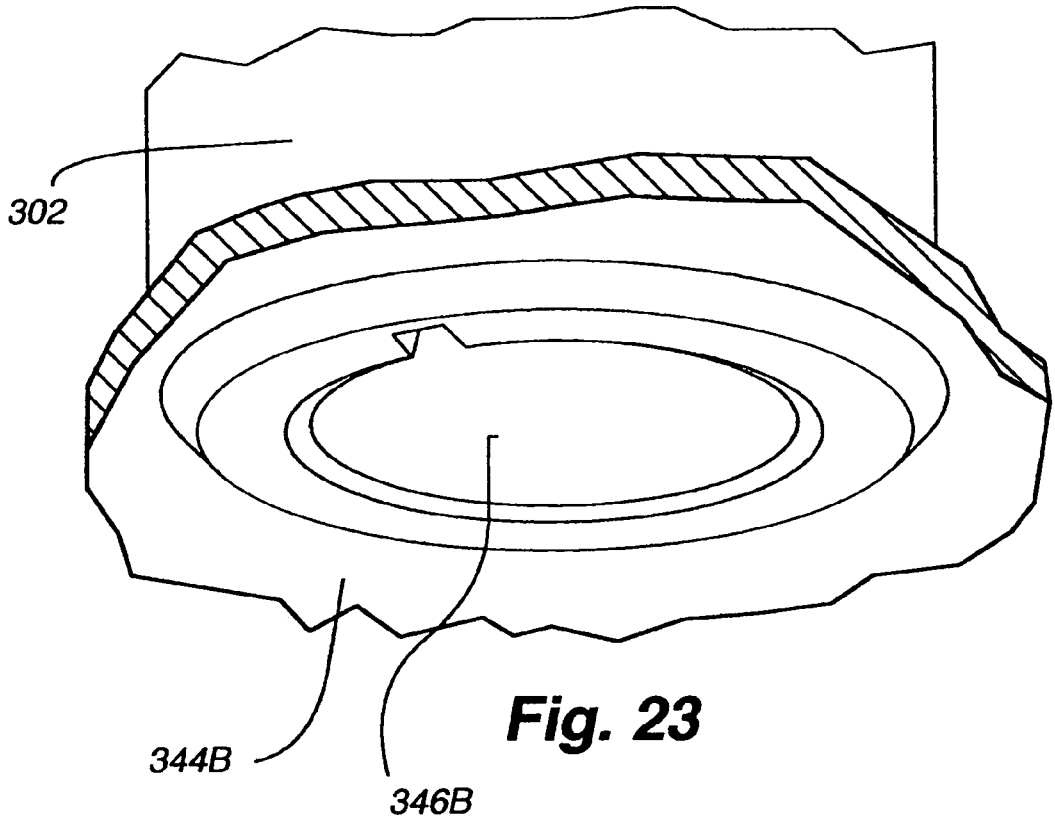
FIG. 23 is a partial view taken along line 23—23 of FIG. 22 illustrating the lower notched opening into which the key chuck of the bottom axle is received.
Figure 24:
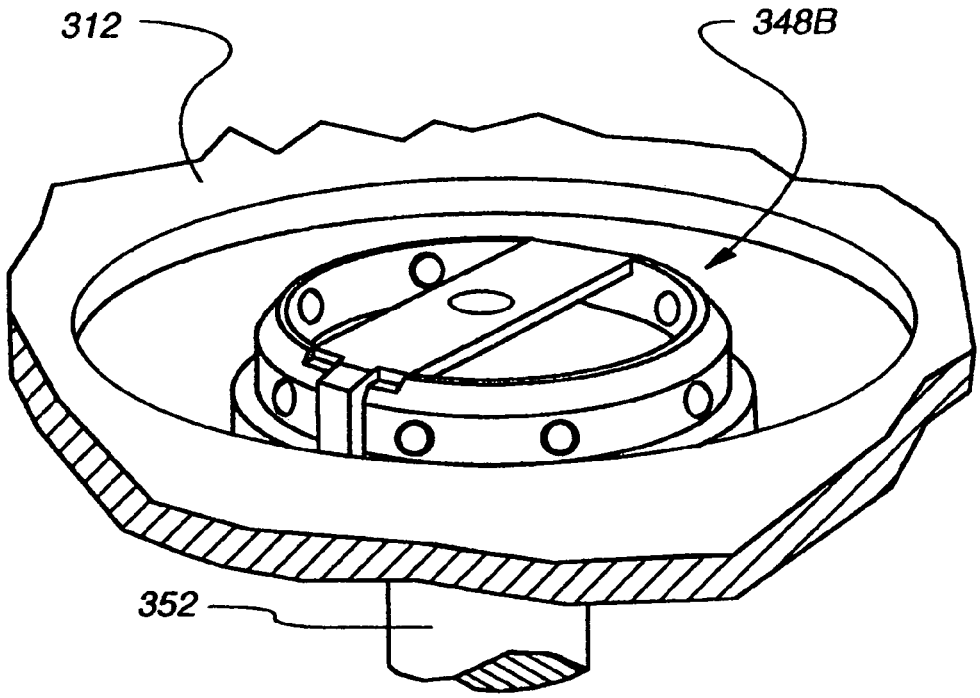
FIG. 24 is a partial view taken along line 24—24 of FIG. 22 illustrating the keyed chuck of the bottom axle.

From the second alignment roller 308, the aligned yarn sheet is wound onto the beam 302. A typical beam 302, as shown in FIG. 13, comprises a central cylindrical core 342 that circumscribes a center axis of the beam about which the beam is generally rotated. A circular flange 344A and 344B typically extends radially outwardly from both the top and bottom ends of the beam. The flanges 344A and 344B act to protect the edges of yarn sheet 102 that has been wound onto a beam 302 as the full beam is moved from the beam winder to the next apparatus that will utilize the yarn sheet, such as a loom. The beam also includes notched openings 346A and 346B (as shown in FIG. 22) at each end that are centered about the center axis of the beam. The notched openings are adapted to receive keyed chucks 348A and 348B of the top and bottom axles 350 and 352 (as shown in FIG. 24) that extend from the framework 214 so that when engaged, the top and bottom axles 350 and 352 spin in unison with the beam.

The top axle 350 is coupled with the framework 214 directly above a first beam 302 that is positioned to receive the yarn sheet 202 thereon. Bearings (not shown) facilitate the free rotation of the top axle relative to the framework. Further, a pneumatic actuator 354 is coupled with the top axle to facilitate the axle's vertical movement. The pneumatic actuator 354 also applies a downwardly directed force when the top axle's chuck 348 is secured to the beam 302 to hold the beam in place during the winding operation.

The bottom axle 352 is affixed to the magnetic clutch 326 for rotation about its center axis. The magnetic clutch 326 is affixed to the framework 214 directly below the first beam 302. As mentioned above, an axle of the magnetic clutch is coupled through a pulley wheel 324 and the associated drive belt 334 with the third stepper motor 318 to rotate the clutch and the beam. The clutch is also electrically coupled to the controller. The controller actively changes the amount of clutch slip to maintain both the proper speed of the beam 302, and the proper amount of tension applied to the yarn sheet 202 as it is wrapped onto the beam based on information received from the tensiometer 310 that is coupled with the first alignment roller 306.

In general, the yarn sheet 202 must be wound onto the beam 302 at a tension that is greater than the tension maintained by the dancer assembly 216 in the preshrink section 200. This tension is necessary to ensure that successive windings of the yarn sheet around the beam nest tightly and compactly against the previously wound portion of the yarn sheet. Ideally, the yarns of the yarn sheet will nest in the gaps between the yarns of the previously wound portion, thereby maximizing the density of the yarn sheet winding 356 on the beam. If winding tension is not high enough, the individual yarns of the yarn sheet winding 356, especially those near the outside of the beam, can shift, slide and become entangled with each other. It can be appreciated that entangled yarn sheets can complicate the unwinding of the sheet in subsequent fabrication operations.

The increased tension is applied to the yarn sheet 202 upstream of the cooling rollers 306 and 308 as the rotating beam through the bottom axle 352 responsive to the magnetic clutch 326 pulls the yarn sheet around its core 342. The rough surface of the cooling rollers sufficiently grip the yarn sheet to prevent the transfer of the greater tension force utilized in the beam section 300 from the portion of the yarn sheet upstream of the cooling rollers that must be kept at a low level of tension to facilitate the preshrink process.

The level of tension applied to the yarn sheet in the beam section 300 must be less than that necessary to cause the yarn sheet to stretch. Any stretch of the yarn sheet in the beam section could increase the potential for shrinkage in a later elevated temperature fabrication operation (such as a pressure lamination), thereby reducing or eliminating effectiveness of the preceding preshrink operation. Accordingly, the actual linear speed of the surface of the yarn sheet in the beam section is preferably the same as the linear speed of the yarn sheet as it passes over the second and third heated rollers 208 and 210 and the cooling rollers 304A and 304B. It is also appreciated that the rotational speed of the beam 302 must constantly be reduced as the diameter of the yarn sheet winding 356 increases to maintain the constant linear speed and desired tension. The magnetic clutch 326 is continuously adjusted by the controller to rotate the beam at the necessary speed to maintain a torque level that correlates to a specified tension force as measured at the tensiometer 332 of the first alignment roller 306. The torque level and related tension level are limited by the magnetic clutch through slippage that prevents the yarn sheet from being over-tensioned.

In the preferred embodiment, a compaction roller assembly 358 is provided to apply a radially inward force against the yarn sheet 202 just after it is wound onto the beam 302 to assist in compacting the yarn sheet winding 356, thereby helping to ensure the proper nesting of the yarns of the successive layers of the winding 356. The compaction roller assembly 358 is comprised of a vertically-orientated roller 360 that is configured to nest at least partially between the flanges 344A and 344B during the winding operation with the compaction roller extending substantially the entire vertical length of the beam between the flanges. The compaction roller is rotateably secured to the ends of a pair of cantilevered arms 362. The other ends of the cantilevered arms 362 are pivotally secured to the framework 214. The shaft of a pneumatic cylinder 364 is pivotally connected to one cantilevered arm between the ends of the arm. The other end of the cylinder 364 is affixed to the beam winder framework. During the beam winding operation, the pneumatic cylinder is activated to pull the roller against the yarn sheet winding and apply an inwardly radially acting force against the yarn sheet winding 356. Once the first beam 302 is full and the winder is stopped, the pneumatic cylinder 364 is then activated to move the compaction roller 360 out from between the flanges 344A and 344B of the first beam so that the beam can be removed and replaced with an empty beam.

In a preferred embodiment, as best shown in FIGS. 20–24, a turntable assembly 366 is provided to assist in switching between a full beam and an empty beam. The turntable assembly is comprised of an elongated generally rectangular plate 312 (or turntable) that is rotateably secured at its center to the end of an actuator shaft 370 of an pneumatic actuator 370 that is mounted to the base of the beam winder framework 214 for moving the plate 312 vertically. On either side of the shaft mounting location the plate is adapted for holding a beam 302. A number of small fences 372 are provided which indicate the proper location of the lower flange 344 B of each of the two beams and indicate the proper positioning of the beams' cores 342 over openings in the plate through which the bottom axle 352 and its chuck 348 can pass.

In operation, the three stepper motors 226, 240, and 318 are brought to a stop once the first beam is full. It is to be appreciated that the controller synchronizes the slow down so the integrity of the aligned yarn sheet 202 is maintained. Once the beam winder has come to a stop, the clamp assembly 336 is actuated to secure the yarn sheet, the compaction roller 360 is retracted, the yarn sheet proximate the beam is cut, and the ends of the yarn sheet are taped to the yarn sheet winding 356. Referring to FIG. 22, the top axle 350 is then retracted vertically to disengage its chuck 348A from the full first beam. Next, the turntable plate 312 is raised until the plate contacts the bottom surface of the lower flange 344B and raises the full first beam to disengage the chuck 348B of the bottom axle 352 therefrom. Once the turntable plate 312 is clear of the chuck 348, an operator can pivot the turntable plate 312 to move the empty second beam 302 to a position between the top and bottom axles and simultaneously move the full beam out of the way. Once the second beam is centered about the bottom axle, the turntable plate is lowered until the opening 346 on the bottom flange receives the chuck of the bottom axle. As necessary either the bottom axle or the second beam may need to be rotated slightly so that the notches of the second beam's lower opening are aligned with and engage the corresponding protrusions on the lower axles' chuck 348. The top axle 350 is lowered next until its chuck 348 is received in and secured to the top opening 346 of the second beam. Finally, the clamp assembly 336 is released, the ends of the yarn sheet 202 are secured to the core of the second beam 302, and the compaction roller 360 is moved back against the beam. The beam winding operation is then resumed. While the second beam is winding, an operator can remove the full first beam and replace it with another empty beam preparing for the next beam switch. It is to be appreciated that the order in which the various operations of the beam switching process are performed may vary while accomplishing the same result.

In summary, the exemplary beam winder described herein provides ease of set up, easy beam switch out with minimal down time, and high quality preshrunk aligned sheets of yarn that help facilitate the production of high quality non-woven fabrics. The yarns from each spool of yarn are quickly and easily fed through a guide tube and alignment comb using a pneumatic feed assemblies. Once all the yarns are fed through the comb, they are wrapped around the plurality of rollers and the ends of the yarns are attached to the beam. In operation, the various servo motors pull the yarn from the spools to the winder. The configuration of the supply section and the guide tubes assure that the level of tension applied to each of the yarns is similar and at a relatively low level. The comb aligns the yarns into a sheet that is fed around a number of rollers in the preshrink section. Several heated rollers heat the yarns causing them to shrink in a uniform manner. A dancer roller is operationally coupled to two servo motors to maintain the proper level of sheet tension. Next, the yarns are cooled by passing over two chilled cooling rollers. The cooling rollers also have a textured surface for gripping the yarns. Next in the beam section, the yarn sheet is pulled around several alignment rollers and onto a beam at a level of tension that is higher than in the preceding preshrink section. The higher level of tension helps ensure that the yarn sheet is compactly nestled against the previously wound portions of the yarn sheet. The textured surface of the cooling rollers prevents the transfer of tension from the yarns in the higher tension beam section to the yarns in the low tension preshrink section. When a beam is fully wound, the beam winder is slowed and stopped. A clamp is activated to secure the upstream aligned yarns in place as the downstream wound yarns are cut. The beam turntable is activated and a new beam is rotated into place. The new beam is coupled to upper and lower axles and the ends of the aligned yarns are attached to the new beam. The winder is then restarted. As the new beam is wound, the operator removes the full beam from the turntable and replaces it with an empty beam for the next beam switch.

Although the present invention has been described with a certain degree of particularity, it is understood that this disclosure has been made by way of example, and changes in detail or structure may be made without departing from the spirit of the invention as defined in the appended claims.

What is claimed is:

1. A method of winding a beam, the method comprising:

aligning a plurality of yarns into a yarn sheet, the plurality of yarns in the yarn sheet being arranged in a parallel planar relationship;

heating the yarn sheet to shrink the yarn sheet prior to winding the sheet onto a beam;

cooling the yarn sheet to stabilize the yarn sheet; and winding the yarn sheet onto a beam.

2. The method of claim 1, further comprising maintaining a substantially equal level of tension among the plurality of yarns as the plurality of yarns are aligned into the yarn sheet.

3. The method of claim 1, further comprising maintaining a substantially equal level of tension among the plurality of yarns of the yarn sheet as the yarn sheet is shrunk.

4. The method of claim 1, wherein said shrinking the yarn sheet further comprises heating the yarn sheet to an elevated temperature.

5. The method of claim 4, wherein said heating the yarn sheet further comprises passing the yarn sheet over and against one or more heated rollers.

6. The method of claim 1, wherein said aligning a plurality of yarns into a yarn sheet further comprises pulling each yarn of the yarn sheet off of a spool and through an associated opening in a comb, the comb having a plurality of openings passing therethrough, each opening being offset from each other opening of the plurality of openings in one direction.

7. The method of claim 1, wherein said winding the yarn sheet onto a beam further comprises compacting the yarns of the yarn sheet against a core of the beam using a compaction roller.

8. A method of winding a beam, the method comprising:

aligning a plurality of yarns into a yarn sheet, the plurality of yarns in the yarn sheet being arranged in a parallel planar relationship;

shrinking the yarn sheet prior to winding the sheet onto a beam;

winding the yarn sheet onto a beam; and wherein the yarns of the yarn sheet are pulled at a first tension level during said shrinking and the yarns of the yarn sheet are pulled at a second tension level during said winding onto the beam, the first level of tension being less than the second level of tension.

9. A method of winding a beam, the method comprising:

aligning a plurality of yarns into a yarn sheet, the plurality of yarns in the yarn sheet being arranged in a parallel planar relationship;

shrinking the yarn sheet prior to winding the sheet onto a beam;

winding the yarn sheet onto a beam;

wherein said aligning a plurality of yarns into a yarn sheet further comprises pulling each yarn of the yarn sheet off a spool and through an associated opening in a comb, the comb having a plurality of openings passing therethrough, each opening being offset from each other opening of the plurality of openings in one direction; and wherein the distance between a spool of each yarn and the associated opening in a comb is substantially the same for each yarn of the plurality of yarns.

* * * * *